US011008831B2

(12) United States Patent
Minassa et al.

(10) Patent No.: US 11,008,831 B2
(45) Date of Patent: May 18, 2021

(54) DUAL LINE HYDRAULIC CONTROL SYSTEM TO OPERATE MULTIPLE DOWNHOLE VALVES

(71) Applicant: Halliburton Energy Services, Inc., Houston, TX (US)

(72) Inventors: Lorenzzo Breda Minassa, Tomball, TX (US); Jonathan Joubran, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/339,437

(22) PCT Filed: May 23, 2018

(86) PCT No.: PCT/US2018/034157
§ 371 (c)(1),
(2) Date: Apr. 4, 2019

(87) PCT Pub. No.: WO2019/226161
PCT Pub. Date: Nov. 28, 2019

(65) Prior Publication Data
US 2021/0071501 A1 Mar. 11, 2021

(51) Int. Cl.
*E21B 34/10* (2006.01)
*E21B 43/12* (2006.01)

(52) U.S. Cl.
CPC ..... *E21B 34/10* (2013.01); *E21B 43/12* (2013.01)

(58) Field of Classification Search
CPC ..... E21B 34/10; E21B 43/12
See application file for complete search history.

(56) References Cited

U.S. PATENT DOCUMENTS 3,568,717 A 3/1971 Plate et al.
4,102,128 A 7/1978 Shafer et al.
(Continued)

FOREIGN PATENT DOCUMENTS

CA 2821553 A1 8/2010
GB 2379685 A 3/2003
(Continued)

OTHER PUBLICATIONS

"*Formation Isolation Valve*", Schlumberger, 2009, 8 pgs.
(Continued)

*Primary Examiner* — Michael R Wills, III
(74) *Attorney, Agent, or Firm* — Haynes and Boone. LLP

(57) ABSTRACT

A method and apparatus for controlling a control valve. A primary line is pressurized according to an operating sequence to move a piston within a housing such that one of an open line port and a close line port is in fluid communication with a selected chamber of a first control chamber and a second control chamber of a plurality of chambers defined between the piston and the housing. A secondary line is pressurized to move hydraulic fluid through the selected chamber and through the one of the open line port and the close line port in fluid communication with the selected chamber to thereby control a state of a control valve. The primary line and the secondary line are pressurized simultaneously according to the operating sequence. The primary line is vented, while the secondary line remains pressurized, to reset a position of the piston within the housing.

20 Claims, 28 Drawing Sheets

(56) References Cited

U.S. PATENT DOCUMENTS

| | | | | |
|---|---|---|---|---|
| 6,470,970 | B1 | 10/2002 | Purkis et al. | |
| 6,502,640 | B2 | 1/2003 | Rayssiguier et al. | |
| 6,722,439 | B2 | 4/2004 | Garay et al. | |
| 7,434,619 | B2 | 10/2008 | Rossi et al. | |
| 7,520,033 | B2 | 4/2009 | Clarner | |
| 7,845,416 | B2 | 12/2010 | Turner et al. | |
| 8,056,643 | B2 | 11/2011 | Basmajian et al. | |
| 8,215,408 | B2 | 7/2012 | Yapici | |
| 8,640,769 | B2 | 2/2014 | Smith et al. | |
| 8,776,890 | B2 | 7/2014 | Basmajian et al. | |
| 9,051,830 | B2 * | 6/2015 | Tips | E21B 43/25 |
| 9,127,528 | B2 | 9/2015 | Panian | |
| 2002/0066573 | A1 | 6/2002 | Patel | |
| 2003/0089407 | A1 | 5/2003 | Bento | |
| 2010/0269935 | A1 | 10/2010 | Breunig et al. | |
| 2017/0261120 | A1 | 9/2017 | Miller et al. | |
| 2017/0306990 | A1 | 10/2017 | Goldfarb | |
| 2018/0298725 | A1 * | 10/2018 | Minassa | E21B 34/10 |

FOREIGN PATENT DOCUMENTS

| | | | |
|---|---|---|---|
| JP | 2013/024345 | A | 2/2013 |
| WO | WO 1997/003293 | A1 | 1/1997 |
| WO | WO 2009/033042 | A1 | 3/2009 |
| WO | WO 2009/111192 | A2 | 9/2009 |
| WO | WO 2015/026354 | A1 | 2/2015 |

OTHER PUBLICATIONS

International Search Report and The Written Opinion of the International Search Authority, or the Declaration, dated Feb. 19, 2019, PCT/US2018/034152, 10 pages, ISA/KR.

International Search Report and The Written Opinion of the International Search Authority, or the Declaration, dated Feb. 15, 2019, PCT/US2018/034157, 10 pages, ISA/KR.

Rahman et al., "*Second-Generation Interval Control Valve (ICV) Improves Operational Efficiency and Inflow Performance in Intelligent Completions*", Society of Petroleum Engineers, 2012, p. 1-13.

* cited by examiner

DUAL LINE HYDRAULIC CONTROL SYSTEM TO OPERATE MULTIPLE DOWNHOLE VALVES

CROSS-REFERENCE TO RELATED APPLICATION

The present application is a U.S. National Stage patent of International Patent Application No. PCT/US2018/034157, filed on May 23, 2018, and entitled "Dual Line Hydraulic Control System To Operate Multiple Downhole Valves," which is related to International Patent Application No. PCT/US2018/034152, filed May 23, 2018, and entitled "Hydraulic Control System for Index Downhole Valves," the entire disclosures of which are hereby incorporated herein by reference.

TECHNICAL FIELD

The present disclosure relates generally to an apparatus and method for controlling one or more valves, and more particularly, to an apparatus and method for hydraulically opening and closing one or more control valves using at least one index piston that is moved into a plurality of index positions using a primary hydraulic line and a secondary hydraulic line that extend to the surface of a well.

BACKGROUND

Different types of control valves are used in wellbores to control the flow of fluid into and out of an oil and gas reservoir. A control valve may be, for example, an isolation valve, an internal control valve, or some other type of valve. Isolation valves are typically used downhole to isolate an oil and gas reservoir from the production string. Isolation valves may be used in a broad range of applications including, but not limited to, fluid loss control, underbalanced perforating, well control barrier operations, lubrication, and multi-zone isolation. Interval control valves may be used to provide remote zonal flow control by choking, permitting, or preventing fluid production or fluid injection from or into the oil and gas reservoir.

Controlling a control valve may include, for example, opening and closing the control valve. Typically, control valves are controlled using mechanical systems. For example, a control valve in a well completion system may include a J-slot mechanism that controls the opening and closing of the control valve. A J-slot mechanism may include a track for an actuating cam or pin that may combine rotation and up or down movement to control the opening and closing of a control valve. In some cases, the parts used in mechanical systems may not have the longevity or service life desired when used for controlling control valves in wellbores. Further, some currently available mechanical systems may not provide the flexibility desired when controlling the state of a control valve.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Illustrative embodiments and related methods of the present disclosure are described below as they might be employed in a hydraulic control system for a set of valves and method of operating the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

Figure 1:
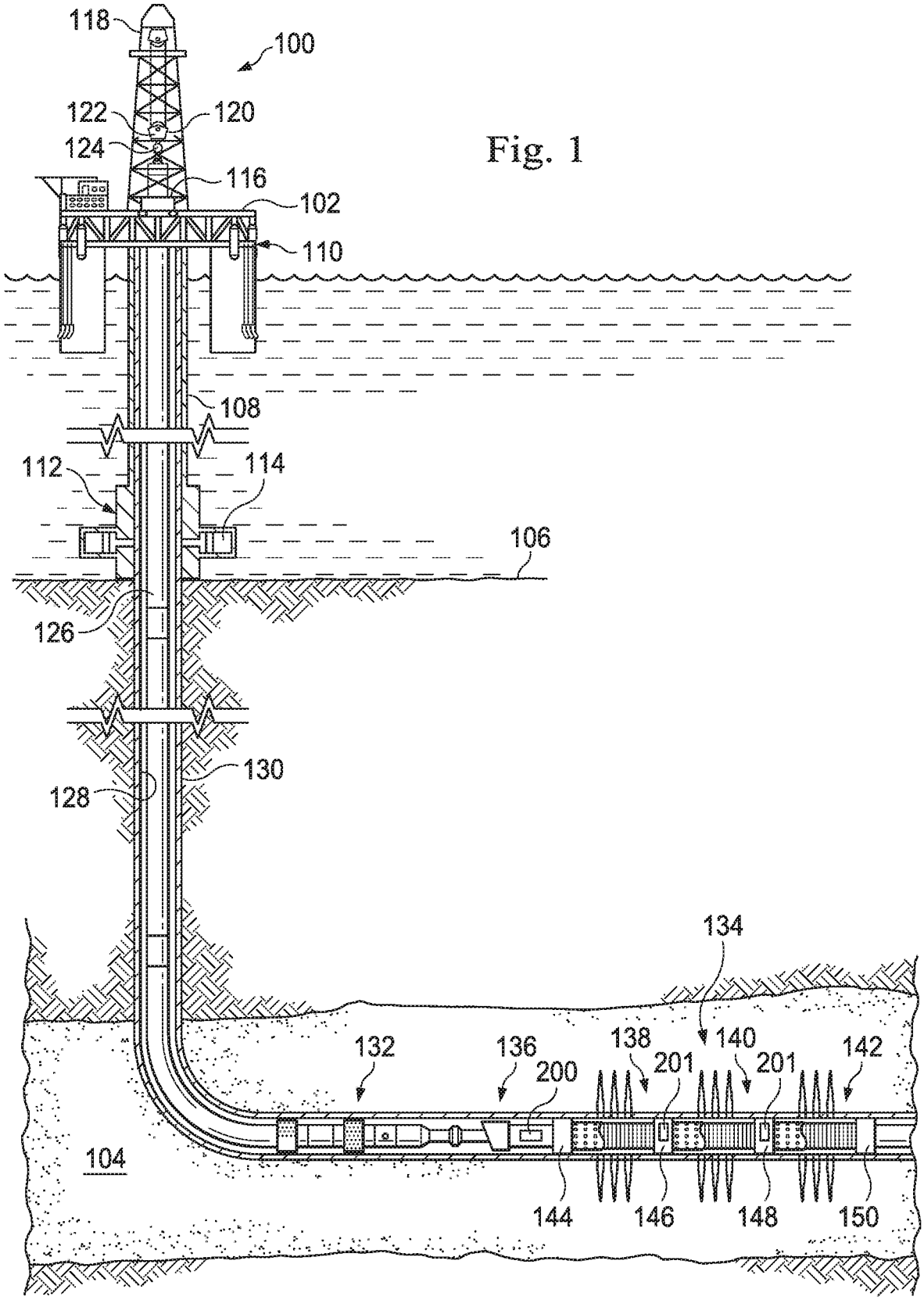
FIG. 1 is a schematic illustration of an offshore oil and gas platform coupled to a set of control valves and a control system for the set of control valves, according to an example embodiment of the present disclosure.

FIG. 1 is a schematic illustration of an offshore oil and gas platform, generally designated 100. A semi-submersible platform 102 may be positioned over a submerged oil and gas formation 104 located below a sea floor 106. A subsea conduit 108 may extend from a deck 110 of the semi-submersible platform 102 to a subsea wellhead installation 112, including blowout preventers 114 or a subsea tree (e.g. a subsea Christmas tree). The semi-submersible platform 102 may have a hoisting apparatus 116, a derrick 118, a travel block 120, a hook 122, and a swivel 124 for raising and lowering pipe strings, such as a substantially tubular, axially extending tubing string 126.

A borehole or wellbore 128, extends through the various earth strata including the submerged oil and gas formation 104, with a portion of the wellbore 128 having a casing string 130 cemented therein. Disposed in the wellbore 128 are an upper completion assembly 132 at a lower end of the tubing string 126 and a lower completion assembly 134 in a substantially horizontal portion of the wellbore 128. The upper completion assembly 132 and the lower completion assembly 134 may be coupled together using a latch assembly 136 to place the lower completion assembly 134 in communication with the upper completion assembly 132. In some embodiments, the latch assembly 136 is considered part of the lower completion assembly 134. In other embodiments, the latch assembly 136 is omitted. The lower completion assembly 134 includes at least one flow regulating system, such as flow regulating system 138, flow regulating system 140, or flow regulating system 142, and may include various other components, such as a packer 144, a packer 146, a packer 148, and a packer 150.

In one or more embodiments, a control system 200 may be used to control a set of control valves 201. The control system 200 is a hydraulic control system. The set of control valves 201 may be used to control the flow of fluid into, out of, and/or within the wellbore 128. Each control valve in the set of control valves may take the form of an isolation valve, an internal control valve, a pressure-regulating valve, a safety valve, some other type of control valve, or a combination thereof.

The set of control valves may be disposed within or relative to various portions of the wellbore 128. In one example embodiment, an isolation valve may be disposed within the portion of the wellbore 128 extending through the submerged oil and gas formation 104 to isolate the submerged oil and gas formation 104 from the interior passageway of the tubing string 126. In another example embodiment, an interval control valve (ICV) may be implemented within upper completion assembly 132 or lower completion assembly 134 to provide remote zonal flow control by choking, permitting, or preventing fluid production or injection between the submerged oil and gas formation 104 and an interior passageway of the tubing string 126.

Even though FIG. 1 depicts a horizontal wellbore, it should be understood by those skilled in the art that the apparatus according to the present disclosure is equally well suited for use in wellbores having other orientations including vertical wellbores, slanted wellbores, uphill wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions.

Figure 2:
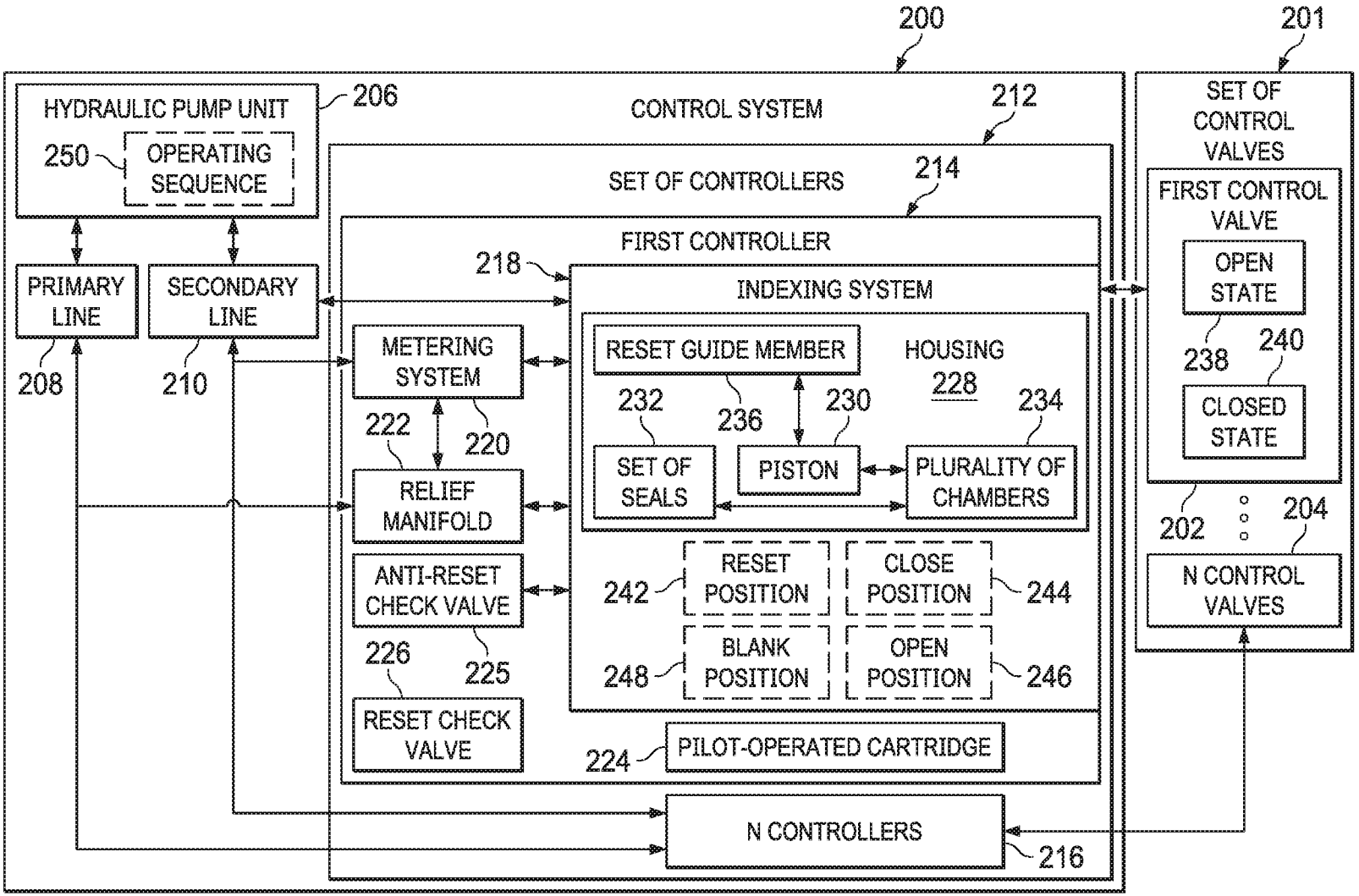
FIG. 2 is a block diagram of a different configuration of a control system for a set of control valves, according to an example embodiment.

FIG. 2 is a block diagram of a control system 200. The control system 200 may be used to control a set of control valves 201. The set of control valves 201 may include one or more control valves. For example, the set of control valves 201 may include a first control valve 202. The control system 200 may also be referred to as a dual line hydraulic control system.

The first control valve 202 may be used at any of a number of points along the tubing string 126, the upper completion assembly 132, and/or the lower completion assembly 134 to control the flow of fluid into, out of, and/or within the interior passageways of the tubing string 126, the upper completion assembly 132, and/or the lower completion assembly 134. The first control valve 202 may take the form of an isolation valve, an internal control valve, a pressure-regulating valve, a safety valve, some other type of valve, or a combination thereof. In one or more embodiments, the set of control valves 201 may include a first control valve 202 and n control valves 204, where n is one or more. Each of the n control valves 204 may be implemented in a manner similar to the first control valve 202.

The control system 200 includes a hydraulic pump unit 206, a primary line 208, a secondary line 210, and a set of controllers 212. In one or more embodiments, the hydraulic pump unit 206 is located at the level of the semi-submersible platform 102. In other embodiments, the hydraulic pump unit 206 may be located at or near the subsea wellhead installation 112. The hydraulic pump unit 206 is fluidly connected to the primary line 208 and the secondary line 210. The primary line 208 and the secondary line 210 are hydraulic lines that carry hydraulic fluid to and from the hydraulic pump unit 206. These hydraulic lines may be individually and independently pressurized by the hydraulic pump unit 206.

The set of controllers 212 may include one or more controllers. For example, the set of controllers 212 may include a first controller 214 for controlling the first control valve 202. In one or more embodiments, the set of controllers 212 may also include up to n controllers 216 for controlling the n control valves 204. Each of the n controllers 216 may be implemented in a manner similar to the first controller 214.

In one or more embodiments, the first controller 214 includes an indexing system 218, a metering system 220, a relief manifold 222, a pilot-operated cartridge 224, an anti-reset check valve 225, and a reset check valve 226. In other embodiments, the hydraulic pump unit 206, the primary line 208, and the secondary line 210 may be considered part of the first controller 214.

The primary line 208 and the secondary line 210 are fluidly connected to the indexing system 218. In other words, each of the primary line 208 and the secondary line 210 may be directly connected to the indexing system 218 or connected to the indexing system 218 through one or more other hydraulic lines, one or more valves, and/or one or more other components.

In one or more example embodiments, the indexing system 218 includes a housing 228 and a piston 230 located within the housing 228. The piston 230 is movable within the housing 228. A plurality of seals 232 is positioned between the piston 230 and the housing 228, thereby defining a plurality of chambers 234 within the housing 228. Each of the plurality of chambers 234 may be filled with hydraulic fluid. The plurality of seals 232 may include one or more seals positioned between the piston 230 and the housing 228 such that the plurality of chambers 234 defined includes at least two chambers. A reset guide member 236 is attached to the piston 230.

The metering system 220 may be fluidly connected to the primary line 208, the secondary line 210, and the indexing system 218. The metering system 220 may be activated by the buildup pressure at the relief manifold 222 when the primary line 208 is pressurized. Further, the metering system 220 controls the volume and rate of hydraulic fluid flowing out of the indexing system 218.

The relief manifold 222 may be fluidly connected to the primary line 208, the metering system 220, and the indexing system 218. In one or more embodiments, the relief manifold 222 controls the flow of hydraulic fluid from the primary line 208 into one of the plurality of chambers 234 in the housing 228 of the indexing system 218.

The reset check valve 226 provides fluid communication between the indexing system 218 and the pilot-operated cartridge 224. The reset check valve 226 controls a flow of hydraulic fluid from the pilot-operated cartridge 224 back into the indexing system 218. The anti-reset check valve 225 controls a flow of hydraulic fluid from the indexing system 218 into the metering system 220 when the piston 230 is moved to different positions within the housing 228 of the indexing system 218.

The hydraulic pump unit 206 pressurizes the primary line 208 and the secondary line 210 individually and independently according to an operating sequence 250. The operating sequence 250 is the specific sequence for pressurizing and venting each of the primary line 208 and the secondary line 210. In some embodiments, the hydraulic pump unit 206 is programmed to cycle through the various stages of pressurizing and venting the primary line 208 and the secondary line 210 according to the operating sequence 250. Accordingly, the first controller 214 may be considered an automated controller. In other embodiments, the hydraulic pump unit 206 may be completely or partially manually controlled.

Pressurizing the hydraulic lines according to the operating sequence 250 moves the piston 230 of the indexing system 218 into various predetermined index positions within the housing 228 of the indexing system 218 to thereby control a state of the first control valve 202. In other words, the piston 230 may be indexed to different positions that control operation of the first control valve 202. For example, these positions may include, but are not limited to, a reset position 242, a close position 244, an open position 246, and a blank position 248. The blank position 248 for the piston 230 may be any index position for the piston 230 that does not cause or affect a change in the state of the first control valve 202. Thus, in some cases, multiple index positions within the housing 228 may be considered the blank position 248.

In one example embodiment, the piston 230 may be moved from the reset position 242, to the close position 244, to the open position 246, to the blank position 248, and back to the reset position 242. In one or more embodiments, the first control valve 202 may be switched to the open state 238 when the piston 230 is moved into the open position 246 and the first control valve 202 may be switched to the closed state 240 when the piston 230 is moved into the close position 244.

In other embodiments, the piston 230 may be moved from the reset position 242, to the blank position 248, to the open position 246, to the close position 244, to another blank position 248, and then back to the reset position 242. In yet other embodiments, the piston 230 may be moved from the reset position 242, to the close position 244, to the open position 246, and back to the reset position 242 without having gone through a blank position 248.

Figure 3:
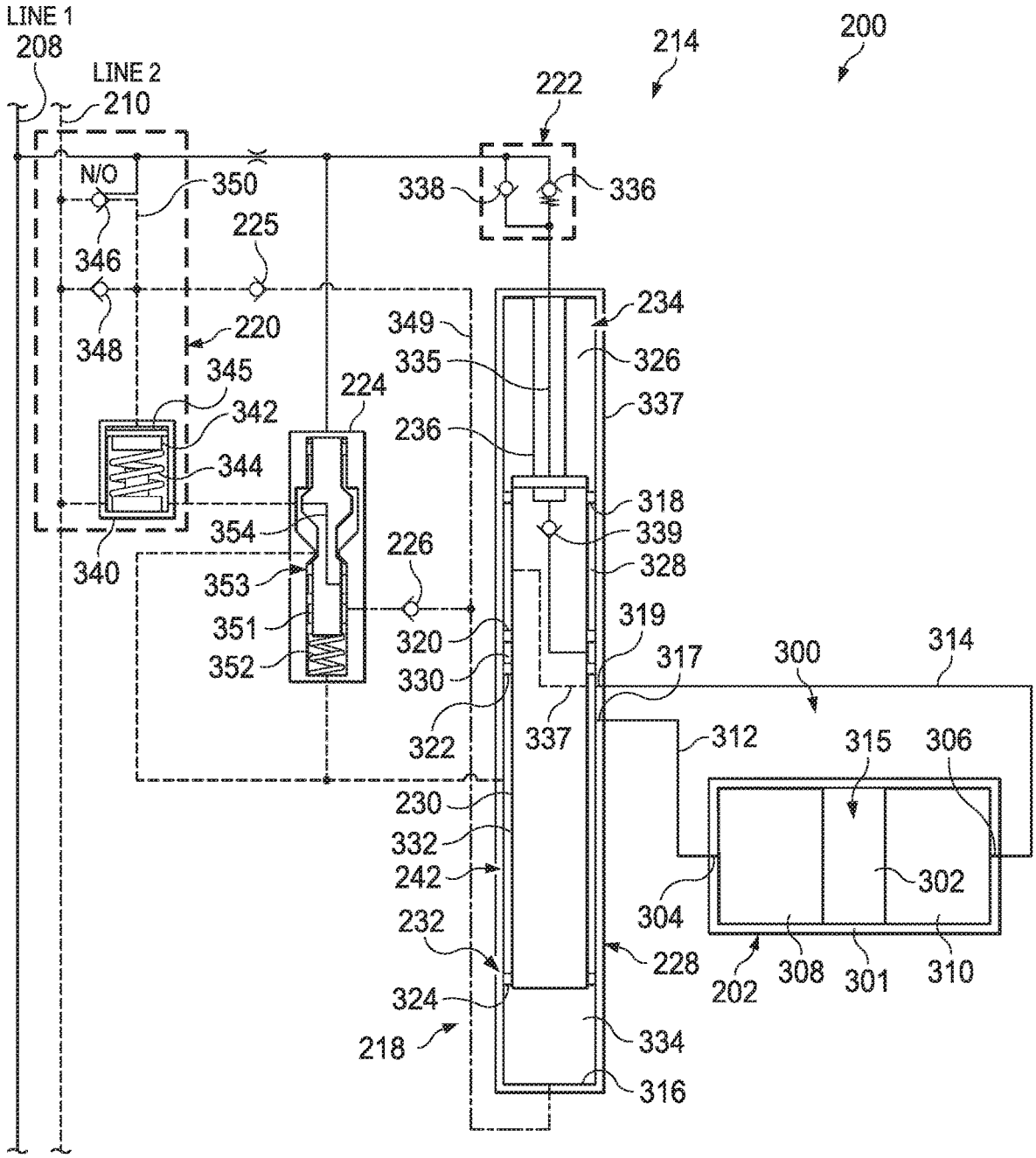
FIG. 3 is a schematic diagram of a configuration of a portion of the control system from FIG. 2 with the first controller and the first control valve at the beginning of a second operating sequence, according to an example embodiment.

FIG. 3 is a schematic diagram of a portion of the control system 200 from FIG. 2 that includes the first controller 214 and the first control valve 202 according to one or more embodiments. The hydraulic pump unit 206 from FIG. 2, to which the primary line 208 and the secondary line 210 of the first controller 214 are fluidly connected, is not shown in these schematic diagrams. The first control valve 202 is in a default state 300 such that the first control valve 202 is partially open and partially closed.

In one or more embodiments, the first control valve 202 includes a housing 301, a plunger 302, a first port 304, and a second port 306. In one or more embodiments, the first control valve 202 may include one or more additional components. Hydraulic fluid may enter and exit the housing 301 of the first control valve 202 through the first port 304 and the second port 306. The movement of hydraulic fluid into and out of the housing 301 may move the plunger 302 within the housing 301. At any given moment during operation of the first controller 214 and the first control valve 202, the positioning of the plunger 302 may define a first space 308, a second space 310, or both within the housing 301 of the first control valve 202. Hydraulic fluid fills the first space 308 and the second space 310.

The first port 304 fluidly connects the first control valve 202 to a close line 312. The second port 306 fluidly connects the first control valve 202 to an open line 314. Hydraulic fluid may enter or exit the first port 304 through the close line 312. Further, hydraulic fluid may enter or exit the second port 306 through the open line 314.

When hydraulic fluid in the close line 312 enters the first control valve 202 through the first port 304, the plunger 302 may move towards the second port 306 to put the first control valve 202 in the closed state 240. When hydraulic fluid in the open line 314 enters the first control valve 202 through the second port 306, the plunger 302 moves towards the first port 304 to put the first control valve 202 in the open state 238.

In FIG. 3, the plunger 302 is shown in a default position 315, indicating that the first control valve 202 is in a default state 300. In the default state 300, the first control valve 202 may be considered half open and half closed. The plunger 302 being in the default position 315 defines the first space 308 and the second space 310, both of which are filled with hydraulic fluid. In the default state 300, the pressure in the first space 308 and the second space 310 may be substantially equalized such that the first control valve 202 is considered equalized.

The close line 312 and the open line 314 are fluidly connected to the indexing system 218 through a close line port 317 and an open line port 319, respectively. The close line port 317 and the open line port 319 may be openings in the housing 228 that allow fluid communication between these ports and some portion of the plurality of chambers 234. Which chamber of the plurality of chambers 234 is in communication with the close line port 317 and which chamber of the plurality of chambers 234 is in communication with the open line port 319 depend on the position of the piston 230 within the housing 228. As depicted, the indexing system 218 includes the housing 228 and the piston 230 located in the housing 228. The housing 228 has an inner wall 316 that defines an open space within which the piston 230 is located. In one or more embodiments, the housing 228 and the piston 230 are both cylindrical.

The plurality of seals 232 is positioned between the piston 230 and the inner wall 316 of the housing 228. In one or more embodiments, the plurality of seals 232 is fixedly attached to the piston 230 such that when the piston 230 moves with the housing 228, the plurality of seals 232 moves with the piston 230.

The plurality of seals 232 includes a first seal 318, a second seal 320, a third seal 322, and a fourth seal 324 positioned between the piston 230 and the inner wall 316 to define the plurality of chambers 234 in the housing 228. A seal in the plurality of seals 232 may be implemented using, for example, without limitation, an O-ring or some other type of fluid-tight seal. The plurality of chambers 234 includes a first chamber 326, a second chamber 328, a third chamber 330, a fourth chamber 332, and a fifth chamber 334. In some embodiments, the first chamber 326, the second chamber 328, the third chamber 330, the fourth chamber 332, and the fifth chamber 334 may be referred to as an index chamber, a control chamber, an auxiliary chamber, a control chamber, and a reset chamber, respectively. In one illustrative embodiment, the fourth chamber 332 may be referred to as a first control chamber and the second chamber 328 may be referred to as a second control chamber.

In one or more embodiments, the first chamber 326 is defined by the inner wall 316, the piston 230, and the first seal 318. The second chamber 328 is defined by the inner wall 316, the piston 230, the first seal 318 and the second seal 320. The third chamber 330 is defined by the inner wall 316, the piston 230, the second seal 320, and the third seal 322. The fourth chamber 332 is defined by the inner wall 316, the piston 230, the third seal 322, and the fourth seal 324. The fifth chamber 334 is defined by the inner wall 316, the piston 230, and the fourth seal 324.

The piston 230 includes a first channel 335 and a second channel 337 that allow hydraulic fluid to flow through the piston 230 and allows fluid communications between at least four of the plurality of chambers 234. The first channel 335 allows fluid communication between the first chamber 326 and the third chamber 330. However, a check valve 339 is positioned within the piston 230 to control the direction of flow between these chambers. The check valve 339 only allows hydraulic fluid to flow from the third chamber 330 into the first chamber 326 and prevents the hydraulic fluid that passes from the relief valve 336 into the first chamber 326 from moving into the third chamber 330. The second channel 337 allows fluid communication between the second chamber 328 and the fourth chamber 332. The second channel 337 may also be referred to as a control channel.

The relief manifold 222 controls the flow of hydraulic fluid in the primary line 208 to the indexing system 218 and controls the pressure buildup required to operate the metering system 220. In one or more embodiments, the relief manifold 222 includes a relief valve 336 and a check valve 338. The relief valve 336 is a one-directional valve that remains closed unless the pressure in the primary line 208 at the inlet of the relief valve 336 is at or above a selected pressure threshold. In one example embodiment, the selected pressure threshold for the relief valve 336 is about 1000 psi (pounds per square inch). The check valve 338 is a one-directional valve that allows the flow of hydraulic fluid in the direction away from the indexing system 218 but blocks the flow of hydraulic fluid in the direction towards the indexing system 218.

In one or more embodiments, the metering system 220 includes a housing 340, a piston 342, a spring 344, a seal 345, a pilot valve 346, and a check valve 348. The piston 342, the spring 344, and the seal 345 are located with the housing 340. The piston 342 may be fixedly attached to the spring 344 and is movable within the housing 340. The seal 345 may be disposed around the piston 342 and may be used to define two different spaces, or chambers, within which hydraulic fluid may move.

In some embodiments, the housing 340 and the piston 342 are cylindrical in shape. In one or more embodiments, the seal 345 may take the form of, for example, an O-ring that is fixedly attached to the piston 342. Thus, the seal 345 may move with the piston 342 within the housing 340. The seal 345 may be disposed around the piston 342 and may be used to define two different spaces, or chambers, where hydraulic fluid may move. One of these chambers is fluidly connected to the fifth chamber 334 within the housing 228 of the indexing system 218 through a fluid line 349. In some embodiments, the fluid line 349 may be considered a segment of the secondary line 210. The check valve 348 is a one-directional valve that allows the flow of hydraulic fluid in one direction and blocks the flow of hydraulic fluid in the opposite direction. The check valve 348 fluidly connects a fluid line 349 to the secondary line 210.

The pilot valve 346 fluidly connects a fluid line 350 to the secondary line 210. The pilot valve 346 may be a one-directional, pilot-operated valve that remains open unless the pressure in the primary line 208 at the pilot valve 346 builds to or above a selected pressure threshold that is less than the selected pressure threshold for the relief valve 336. In other words, a flow of fluid may be allowed between the fluid line 350 and the secondary line 210 when the pilot valve 346 is open until the pressure buildup at the pilot valve 346 from the primary line 208 reaches or exceeds the selected pressure threshold. In one example embodiment, the selected pressure threshold for the pilot valve 346 is about 500 psi. The check valve 348 is a one-directional valve that allows the flow of hydraulic fluid in one direction and blocks the flow of hydraulic fluid in the opposite direction.

The pilot-operated cartridge 224 controls a flow of hydraulic fluid from the secondary line 210 into the indexing system 218. The pilot-operated cartridge 224 includes a member 351 and a spring 352 fixedly attached to the member 351. The pilot-operated cartridge 224 also includes seals 353, which may be fixedly attached to the member 351 to thereby define chambers within a housing of the pilot-operated cartridge 224. In these embodiments, the member 351 is movable within the pilot-operated cartridge 224. The member 351 includes a bypass channel 354.

The reset check valve 226 is a one-directional valve that provides fluid communication between the pilot-operated cartridge 224 and the indexing system 218 when the first controller 214 is being reset. Hydraulic fluid may flow from the pilot-operated cartridge 224, through the reset check valve 226, and back into the indexing system 218 to move the piston 230 into the reset position 242. The anti-reset check valve 225 is a one-directional valve that allows hydraulic fluid, which is being pushed out of the indexing system 218 when the piston 230 is being moved downwards, to move into the housing 340 of the metering system 220. Thus, the anti-reset check valve 225 only allows hydraulic fluid to pass through when the piston 230 is not being moved into the reset position 242.

The piston 230 is shown in the reset position 242 in FIG. 3. The reset guide member 236 determines how far from a top of the housing 228 the piston 230 is positioned when the piston 230 is in the reset position 242. With the piston 230 in the reset position 242, the open line 314 and the close line 312 are in fluid communication with the same chamber of the indexing system 218, the fourth chamber 332. When the open line 314 and the close line 312 are in fluid communication with the same chamber, the first control valve 202 may be equalized.

The piston 230 may be kept in the reset position 242 and the first control valve 202 may be kept in the default state 300 when the first controller 214 and the first control valve 202 are lowered into the wellbore 128 of FIG. 1. Both the first controller 214 and the first control valve 202 are equalized as the first controller 214 and the first control valve 202 are lowered into the wellbore 128. In particular, the primary line 208 and the secondary line 210 are equalized such that one is not more pressurized than the other.

FIGS. 4-16 are schematic diagrams describing one example implementation of the operating sequence 250 used by the first controller 214 from FIG. 3 to control operation of the first control valve 202 in FIG. 3. FIGS. 17-26 describe movement of the piston 230 from the reset position 242, to the close position 244, to the open position 246, to the blank position 248, and back to the reset position 242.

Figure 4:
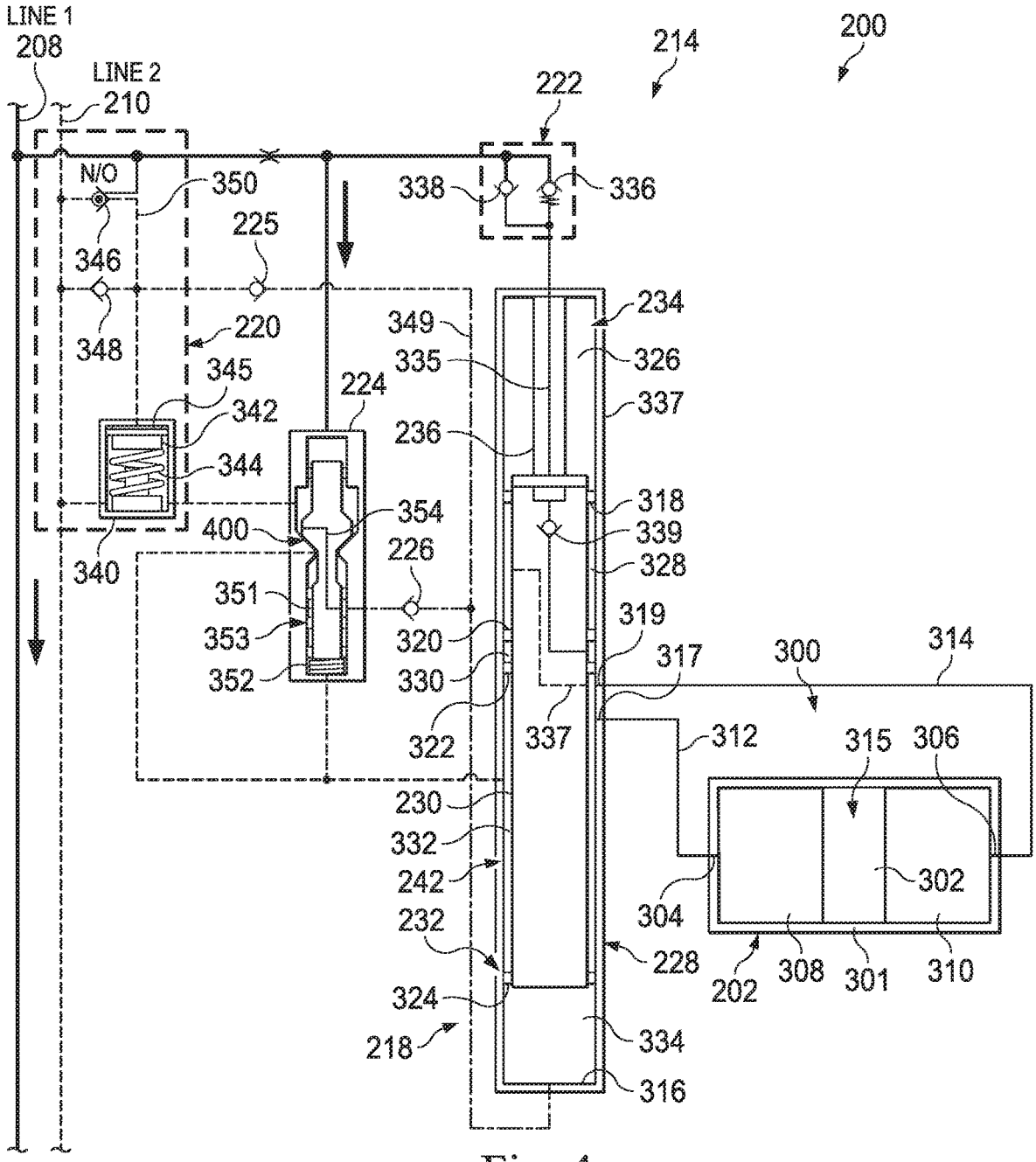
FIG. 4 is a schematic diagram of another configuration of the first controller and the first control valve of FIG. 3 during the second operating sequence, according to an example embodiment.

In FIG. 4, the piston 230 is in the reset position 242. The first control valve 202 is in the default state 300 such that the first control valve 202 is partially open and partially closed. To begin the operating sequence 250, the hydraulic fluid is transferred from the hydraulic pump unit 206 (not shown) into the primary line 208 to begin pressurizing the primary line 208.

The pressure in the primary line 208 has reached a selected pressure threshold for the pilot valve 346 but has not yet reached the cracking pressure for the relief valve 336. Accordingly, the pilot valve 346 is closed by the pressurization of the primary line 208 but the relief valve 336 remains closed.

The pressure in the primary line 208 causes the hydraulic fluid to move into the pilot-operated cartridge 224. The hydraulic fluid moves the member 351 downwards from its original position, which is an open position, into a close position, thereby compressing the spring 352 and closing the pilot-operated cartridge 224. When the pilot-operated cartridge 224 is closed with the member 351 in the closed position, the member 351 creates a seal 400 against a housing of the pilot-operated cartridge 224. This seal 400, which may be a metal-to-metal seal, prevents the hydraulic fluid in the pilot-operated cartridge 224 from moving out of the pilot-operated cartridge 224 into the fourth chamber 332. Further, when the pilot-operated cartridge 224 is closed, the by-pass which will allow supply fluid from the secondary line to the inlet of the reset check valve 226.

Figure 5:
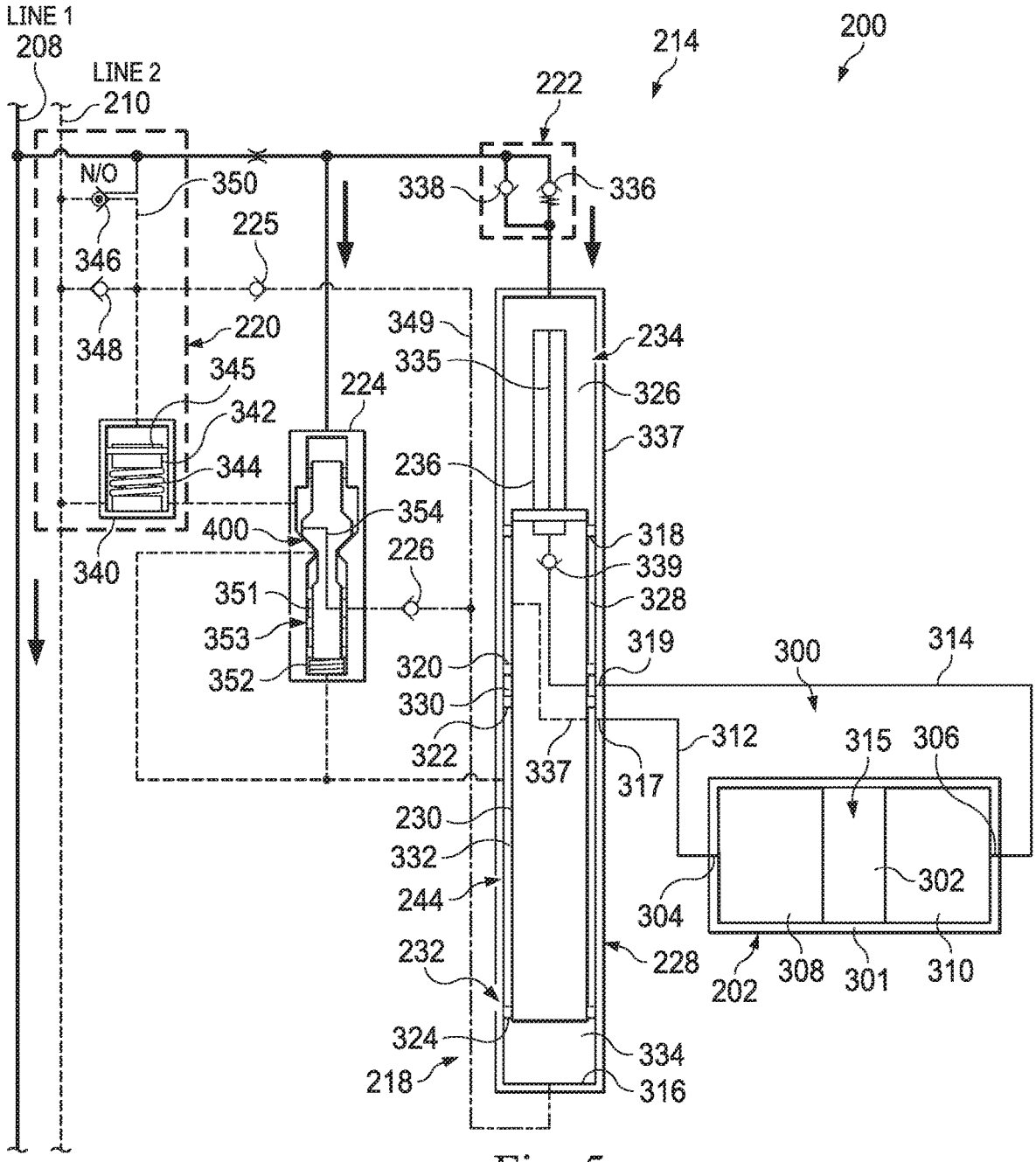
FIG. 5 is a schematic diagram of yet another configuration of the first controller and the first control valve of FIG. 3 during the second operating sequence, according to an example embodiment.

In FIG. 5, the pressure in the primary line 208 has reached the cracking pressure for the relief valve 336. In particular, the pressure has reached or exceeded the full-flow pressure of the relief valve 336. Thus, hydraulic fluid moves through the primary line 208, through the relief valve 336 and into the first chamber 326 of the indexing system 218, which moves the piston 230 downwards into the close position 244. In the close position 244, the open line 314 is in fluid communication with the third chamber 330 of the indexing system 218.

Figure 6:
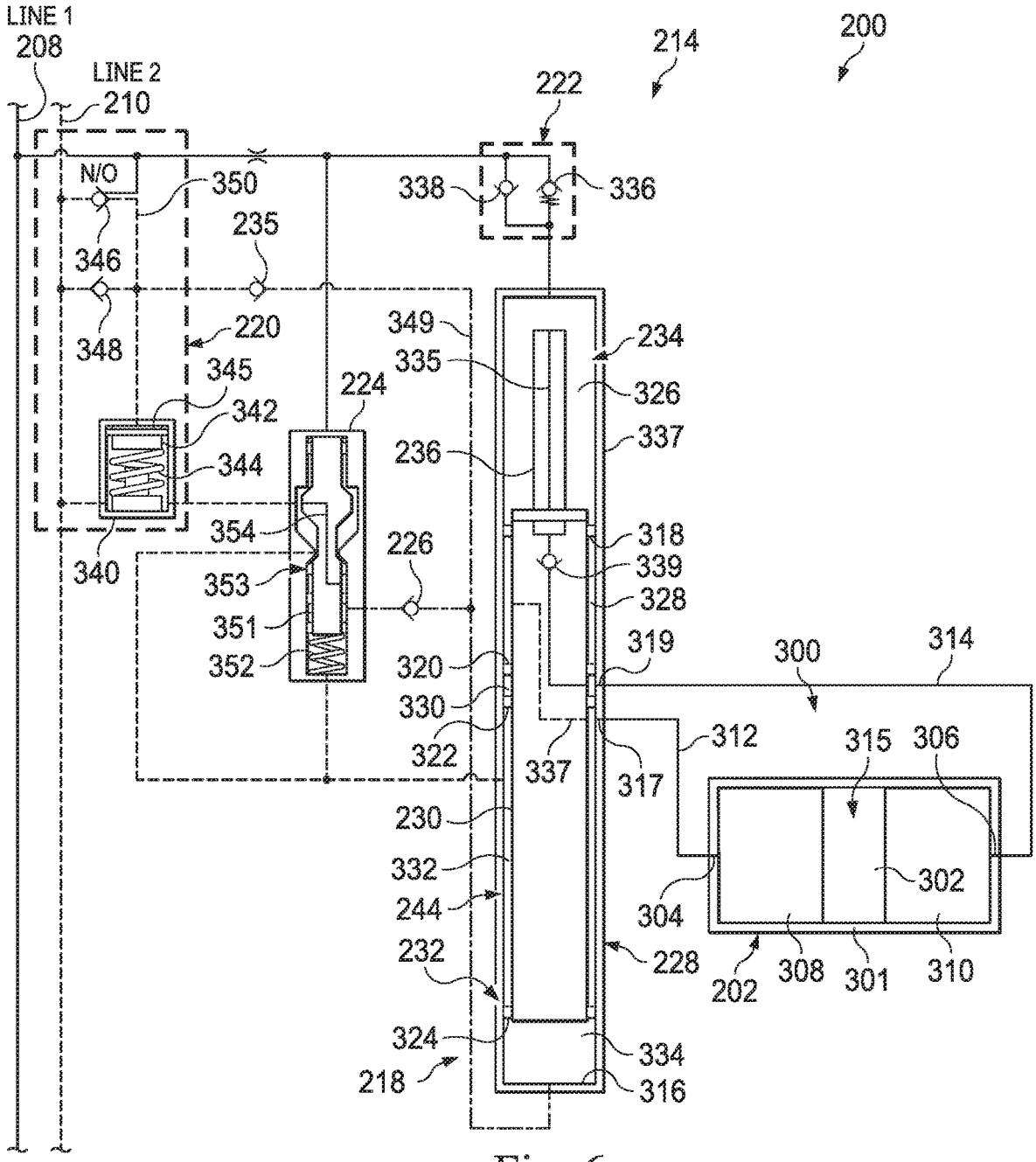
FIG. 6 is a schematic diagram of yet another configuration of the first controller and the first control valve of FIG. 3 during the second operating sequence, according to an example embodiment.

In FIG. 6, the primary line 208 is vented. Venting the primary line 208 causes the pilot valve 346 to open, which thereby allows the metering system 220 to reset. With the pilot valve 346 open, the hydraulic fluid compressed in both the fluid line 350 and the fluid line 349 may flow into the secondary line 210 through the pilot valve 346. Further, the member 351 of the pilot-operated cartridge 224 is moved in the second direction, which may be upwards, back into its original open position. Further, the hydraulic fluid in the housing 340 of the metering system 220 may move out of the housing 340, through the fluid line 349, and through the pilot valve 346. As the hydraulic fluid moves out of the housing 340, the spring 344 of the metering system 220 pushes the piston 342 of the metering system 220 to move the piston 342 back into its original position.

Figure 7:
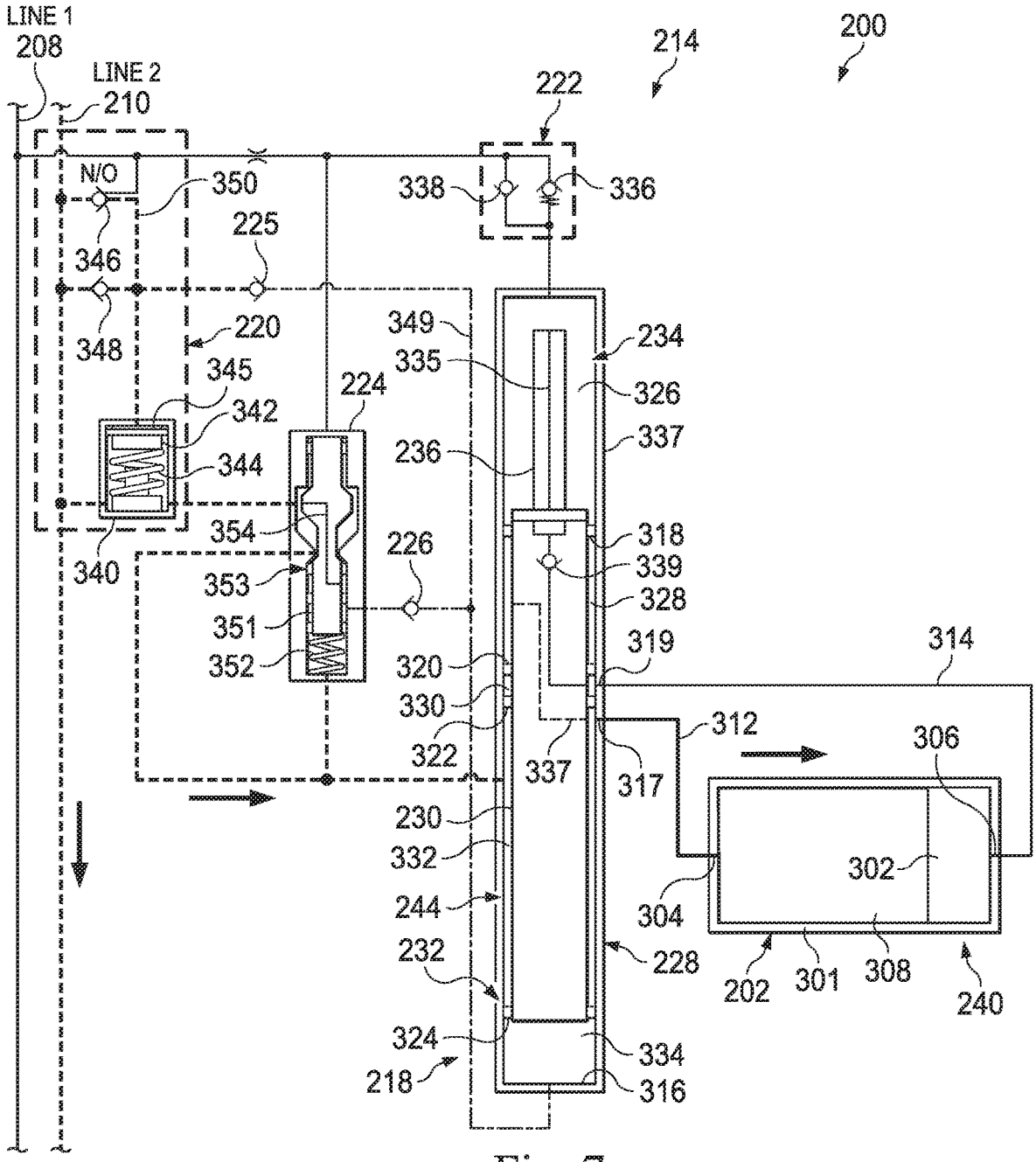
FIG. 7 is a schematic diagram of yet another configuration of the first controller and the first control valve of FIG. 3 during the second operating sequence, according to an example embodiment.

In FIG. 7, the secondary line 210 is pressurized. With the piston 230 in the close position 244, pressurizing the secondary line 210 causes the hydraulic fluid to flow through the secondary line 210, through the normally open pilot-operated cartridge 224, and into the fourth chamber 332 of the indexing system 218. Further, the hydraulic fluid moves from the fourth chamber 332, through the close line 312, and into the first control valve 202. The hydraulic fluid causes the plunger 302 to move towards the second port 306 and switch the first control valve 202 to the closed state 240.

As the plunger 302 is moved towards the second port 306, the hydraulic fluid in the second space 310 within the housing 301 of the control valve is moved out through the second port 306 and through the open line 314. This hydraulic fluid moves through the open line 314 and into the third chamber 330. Further, a portion of the hydraulic fluid in the third chamber 330 may move through the first channel 335 in the piston 230 and into the first chamber 326. The hydraulic fluid from the first chamber 326 will move through the check valve 338 located inside the relief manifold 222 and into the primary line 208. The hydraulic fluid displaced in the primary line 208 may be vented through the hydraulic pump unit 206 of FIG. 2.

Figure 8:
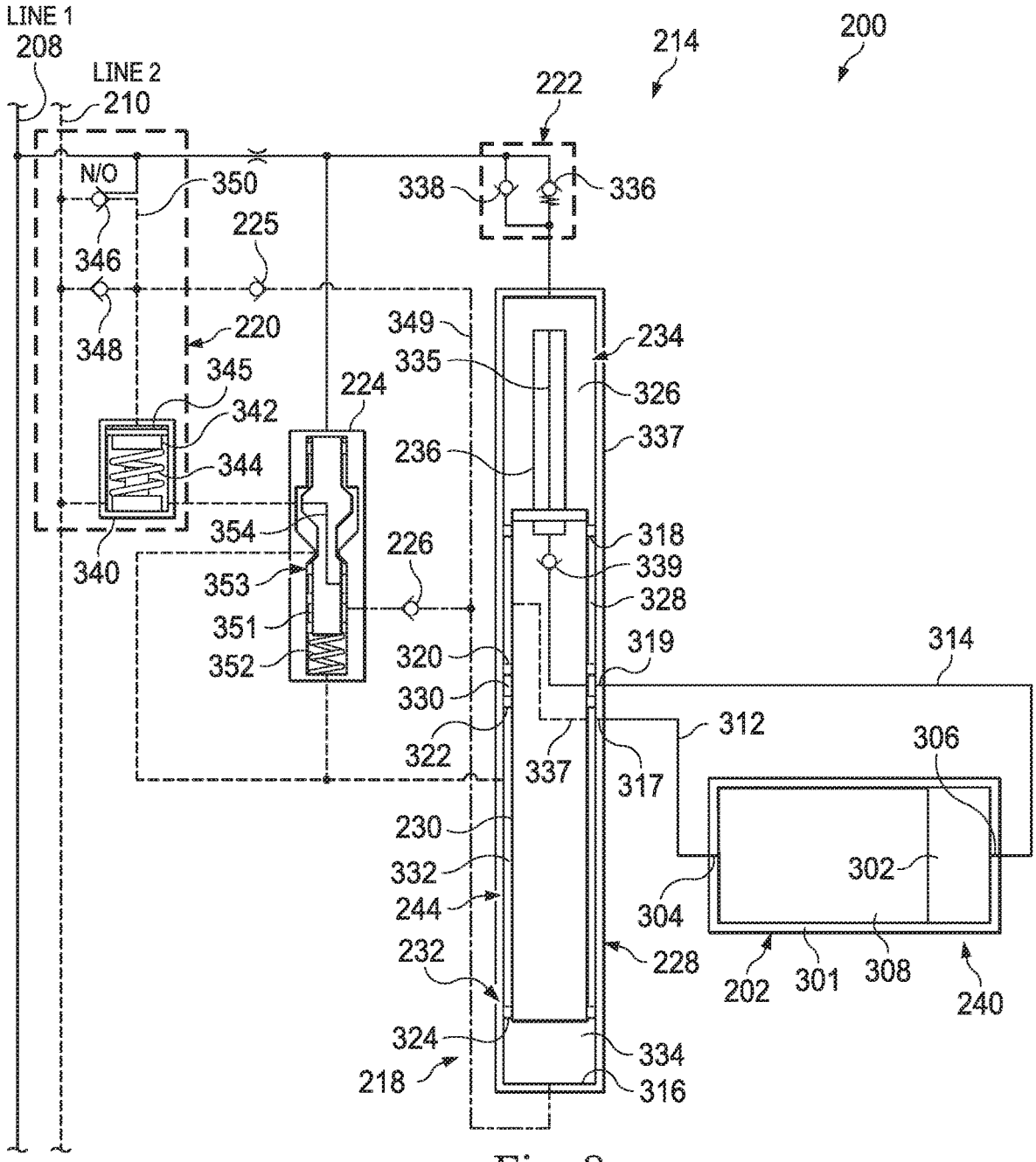
FIG. 8 is a schematic diagram of yet another configuration of the first controller and the first control valve of FIG. 3 during the second operating sequence, according to an example embodiment.

In FIG. 8, the secondary line 210 is vented, thereby equalizing the first controller 214. Venting the secondary line 210 does not affect the state of the first control valve 202.

Figure 9:
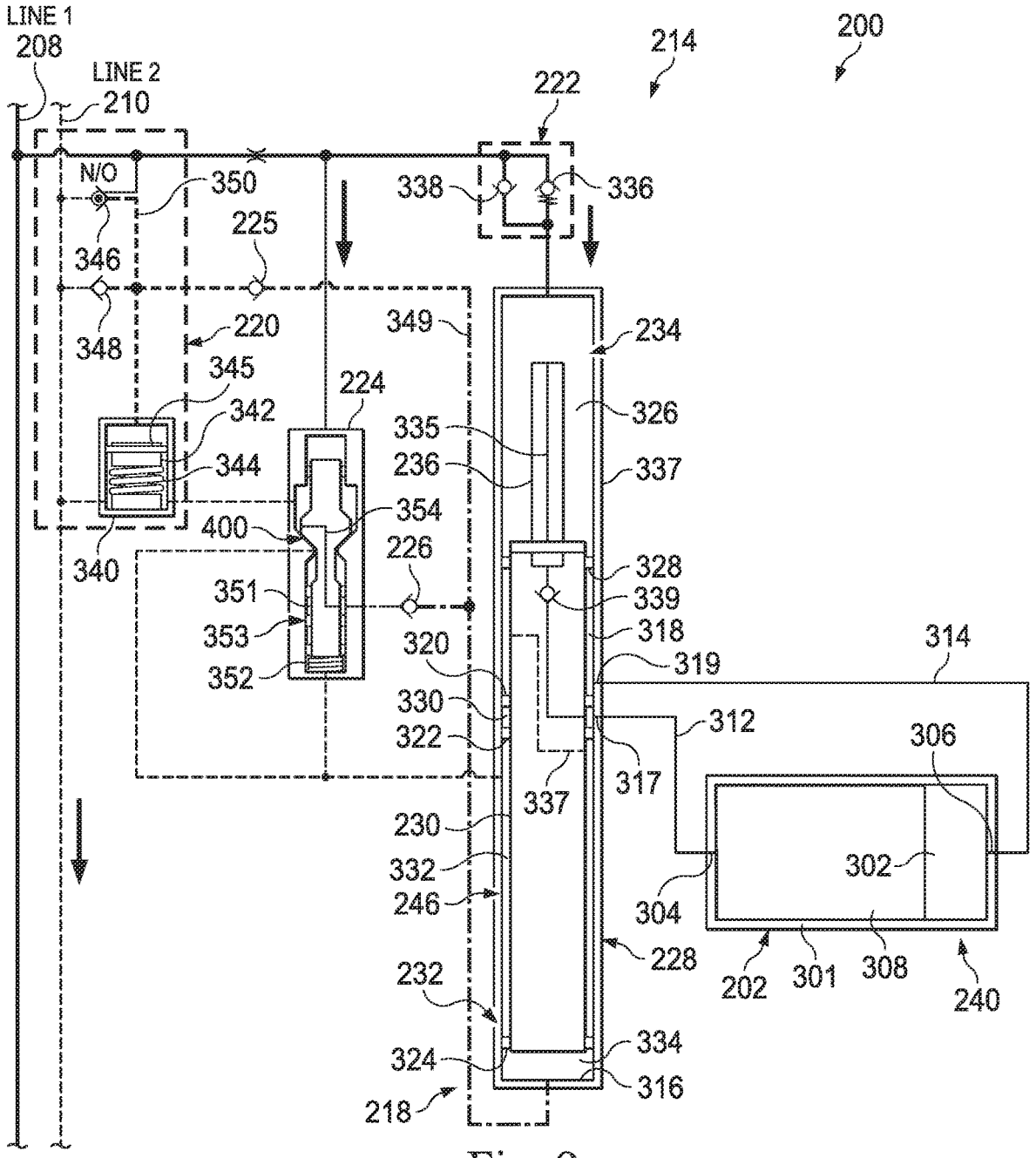
FIG. 9 is a schematic diagram of yet another configuration of the first controller and the first control valve of FIG. 3 during the second operating sequence, according to an example embodiment.

In FIG. 9, the primary line 208 is pressurized again to move the piston 230 into the open position 246. With the piston 230 in the open position 246, the close line 312 is in fluid communication with the third chamber 330 and the open line 314 is in fluid communication with the second chamber 328. When the primary line 208 is pressurized, the member 351 of the pilot-operated cartridge 224 moves into the close position, thereby closing the pilot-operated cartridge 224 and establishing the seal 400.

Figure 10:
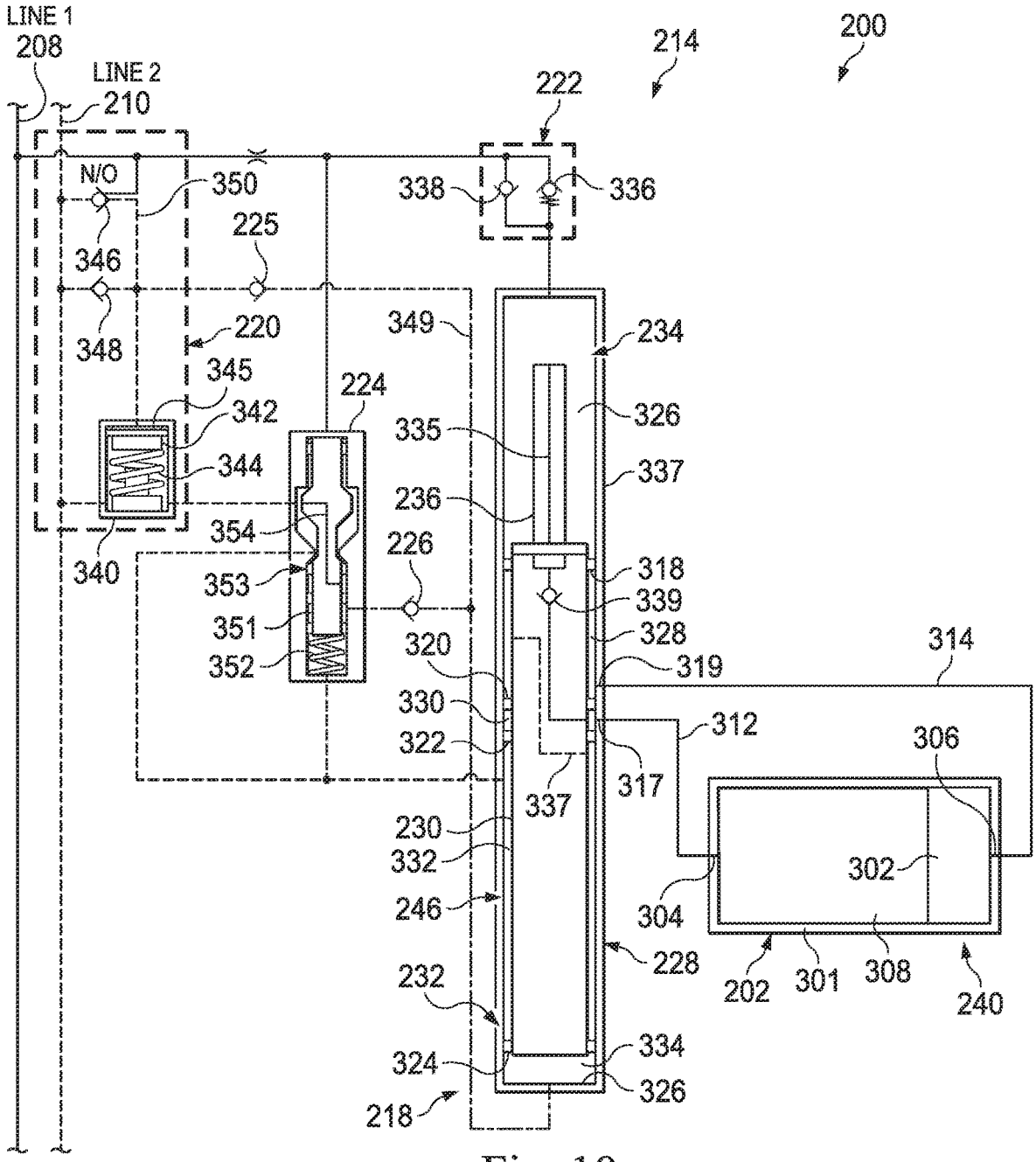
FIG. 10 is a schematic diagram of yet another configuration of the first controller and the first control valve of FIG. 3 during the second operating sequence, according to an example embodiment.

In FIG. 10, the primary line 208 is again vented. Venting the primary line 208 causes the pilot valve 346 to open, which thereby allows the metering system 220 to reset. Further, the member 351 of the pilot-operated cartridge 224 is moved upwards back into its original position, thereby opening the pilot-operated cartridge 224.

Figure 11:
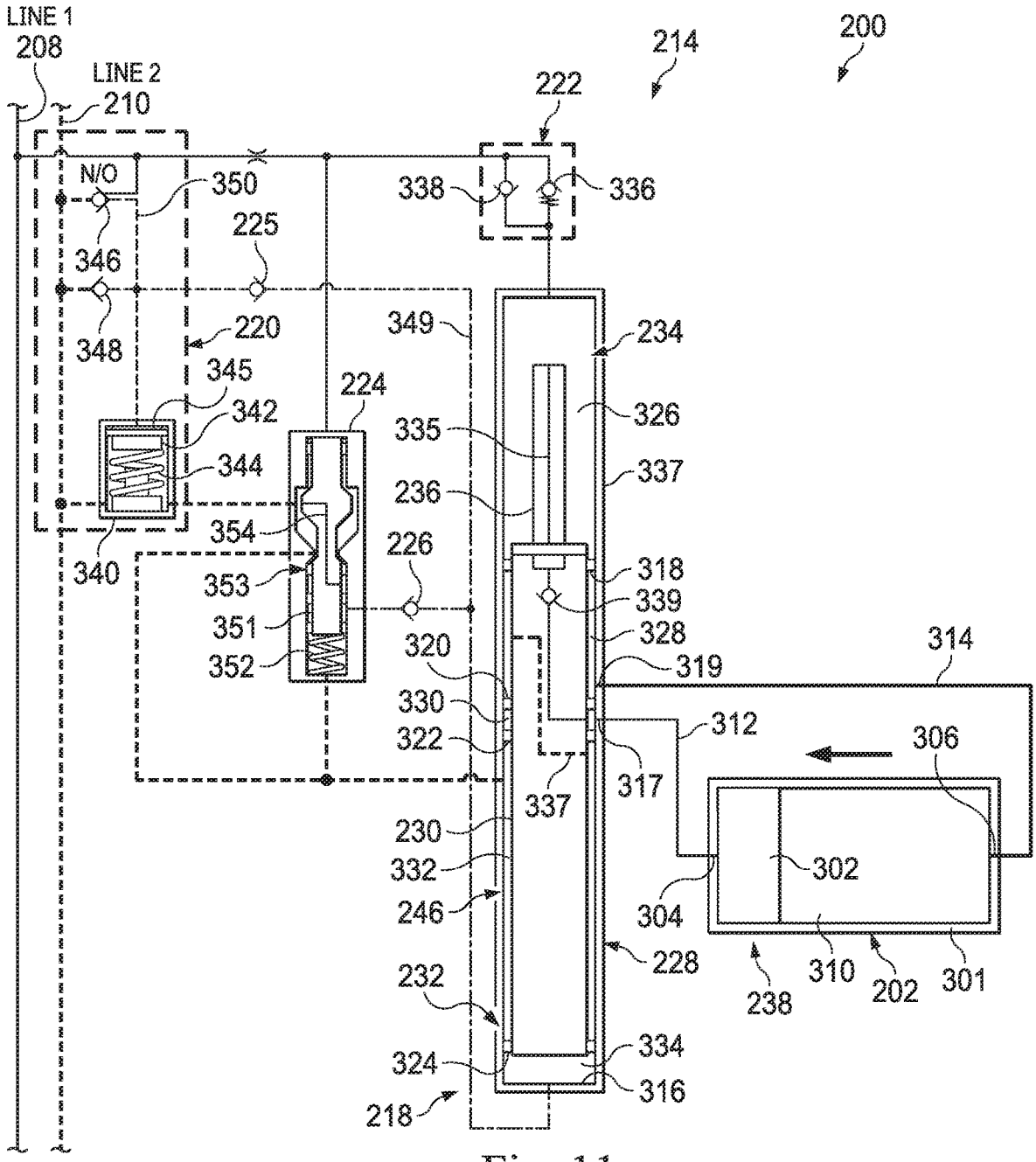
FIG. 11 is a schematic diagram of yet another configuration of the first controller and the first control valve of FIG. 3 during the second operating sequence, according to an example embodiment.

In FIG. 11, the secondary line 210 is pressurized. With the piston 230 in the open position 246, pressurizing the secondary line 210 causes the hydraulic fluid to flow through the secondary line 210, through the open pilot-operated cartridge 224, and into the fourth chamber 332 of the indexing system 218. Further, the hydraulic fluid moves from the fourth chamber 332 into the second chamber 328 through the second channel 207 through the piston 230. The hydraulic fluid in the second chamber 328 moves through the open line 314 and into the first control valve 202. The hydraulic fluid in the first control valve 202 causes the plunger 302 to move towards the first port 304 and switch the first control valve 202 from the closed state 240 to the open state 238.

As the plunger 302 is moved towards the first port 304, the hydraulic fluid in the first space 308 within the housing 301 of the control valve is moved out through the second port 306 and through the close line 312. This hydraulic fluid moves through the close line 312 and into the third chamber 330. Further, a portion of the hydraulic fluid in the third chamber 330 may move through the first channel 335 in the piston 230 and into the first chamber 326. The hydraulic fluid from the first chamber 326 will move through the check valve 338 located inside the relief manifold 222 and into the primary line 208. The hydraulic fluid displaced in the primary line 208 may be vented through the hydraulic pump unit 206 of FIG. 2.

Figure 12:
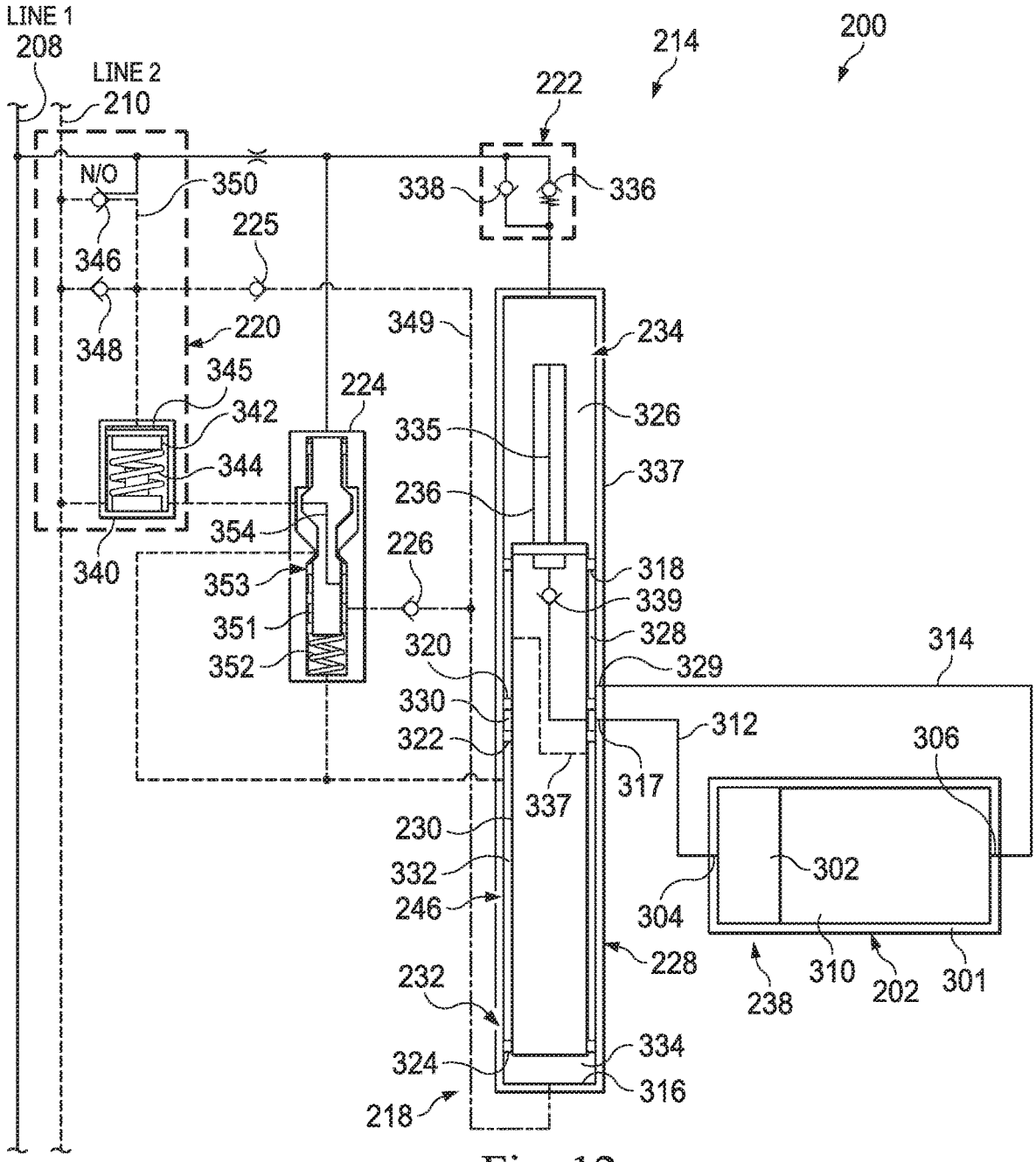
FIG. 12 is a schematic diagram of yet another configuration of the first controller and the first control valve of FIG. 3 during the second operating sequence, according to an example embodiment.

In FIG. 12, the secondary line 210 is vented, thereby equalizing the first controller 214. Venting the secondary line 210 does not affect the state of the first control valve 202.

Figure 13:
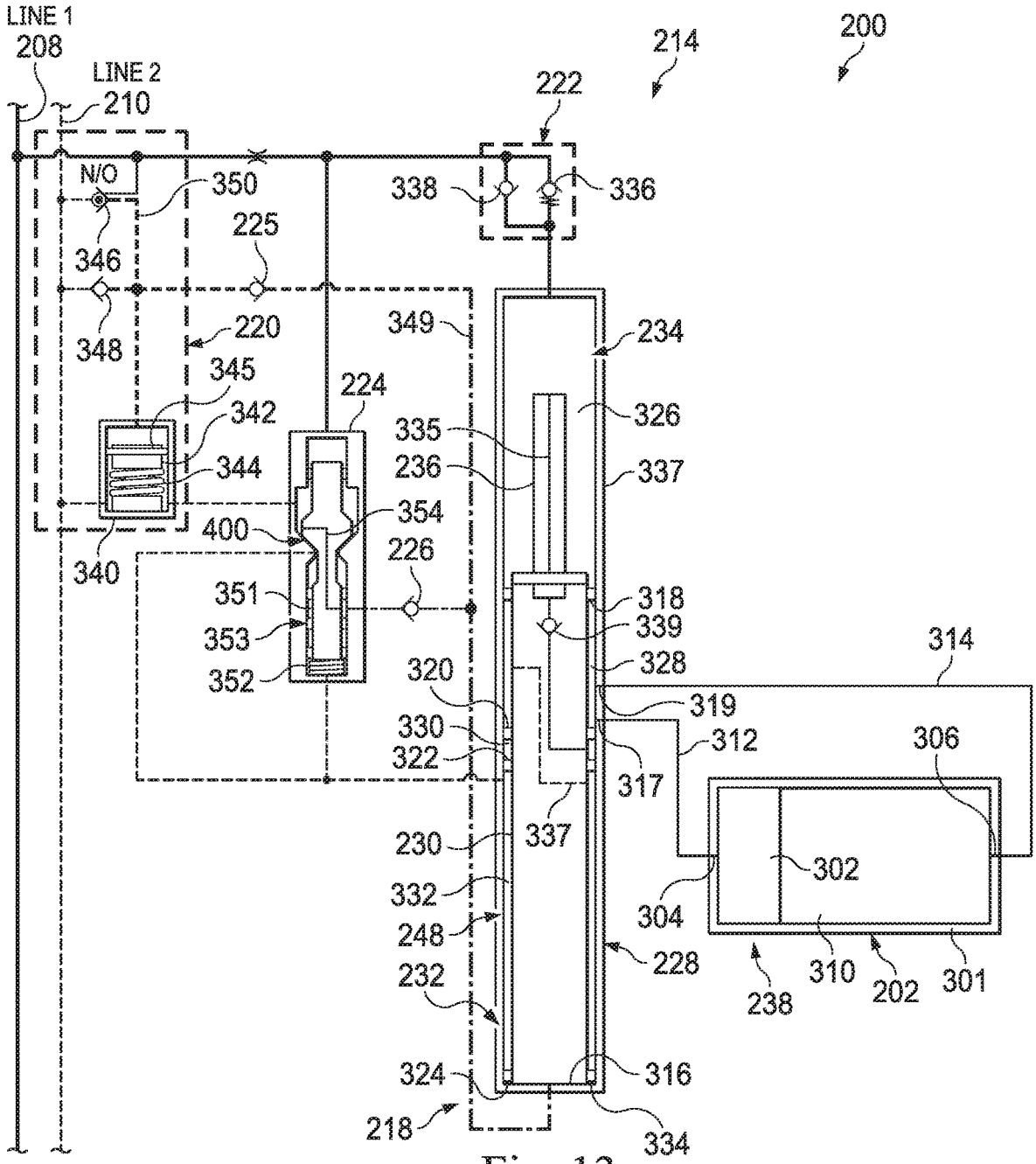
FIG. 13 is a schematic diagram of yet another configuration of the first controller and the first control valve of FIG. 3 during the second operating sequence, according to an example embodiment.

In FIG. 13, the primary line 208 is pressurized again to move the piston 230 into the blank position 248. With the piston 230 in the blank position 248, the close line 312 and the open line 314 are both in fluid communication with the same chamber, which is the second chamber 328. Thus, the first control valve 202 is equalized. When the primary line 208 is pressurized, the member 351 of the pilot-operated cartridge 224 moves into the close position, thereby closing the pilot-operated cartridge 224 and establishing the seal 400.

Figure 14:
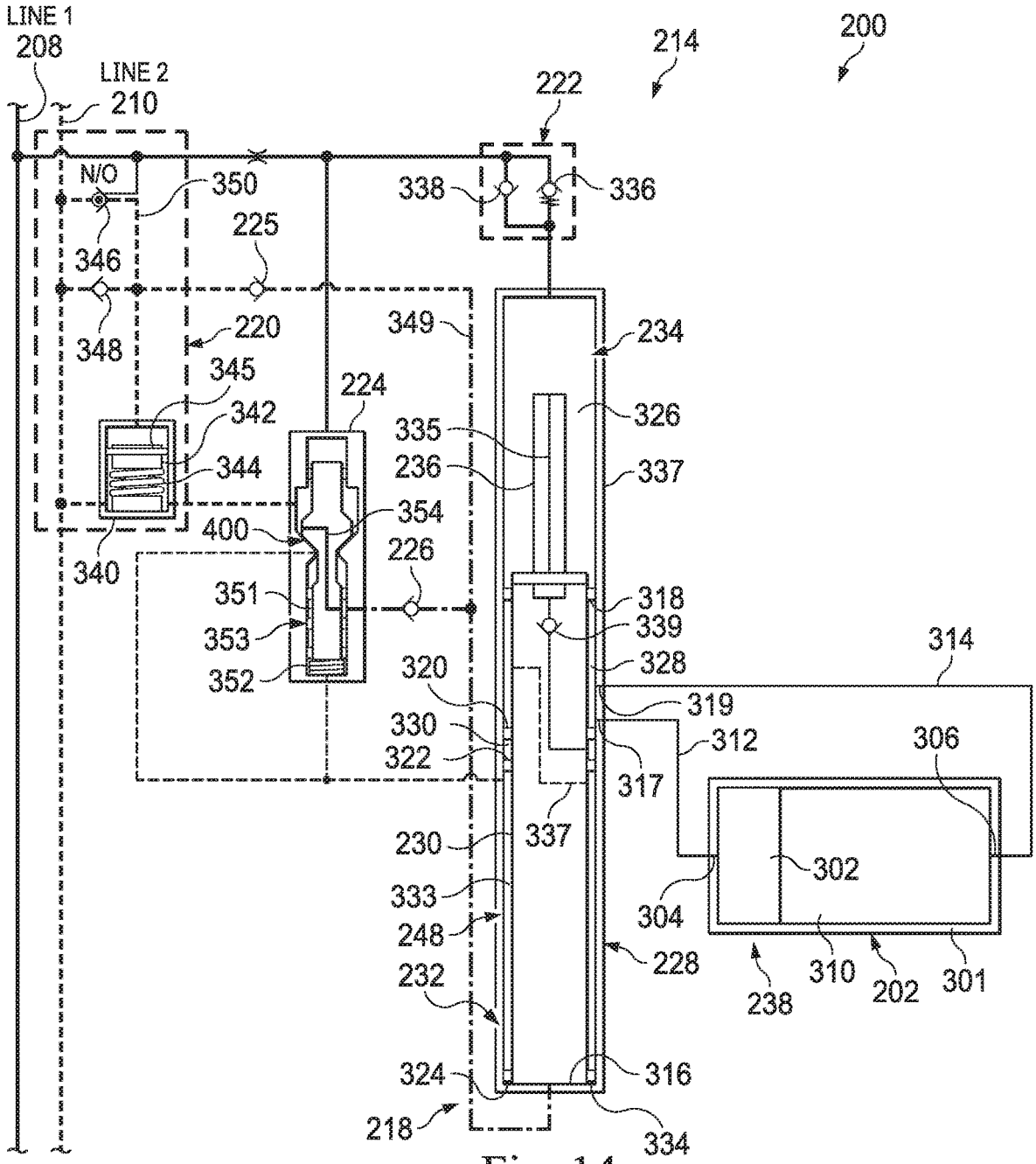
FIG. 14 is a schematic diagram of yet another configuration of the first controller and the first control valve of FIG. 3 during the second operating sequence, according to an example embodiment.

In FIG. 14, the secondary line 210 is pressurized after the primary line 208 has been pressurized and without venting the primary line 208 before pressurizing the secondary line 210. This sequential pressurizing of the primary line 208 and the secondary line 210 initiates a reset code for resetting the indexing system 218, and thereby, the first controller 214. The reset code is a sequence of pressurization and venting that allows the indexing system 218, and thereby the first controller 214, to be reset. In some embodiments, the control system 200 may include multiple controllers. The reset code will reset all controllers in the control system 200.

With the primary line 208 pressurized, the hydraulic fluid moves through the primary line 208 and into the first chamber 326 of the indexing system 218 through the relief valve 336. Further, with the primary line 208 pressurized and the pilot-operated cartridge 224 closed, pressurizing the secondary line 210 causes the hydraulic fluid in the pilot-operated cartridge 224 to move through the bypass channel 354, through the reset check valve 226, and into the fifth chamber 334. With a substantially same level of pressure being applied at the first chamber 326 and the fifth chamber 334, the piston 230 does not move.

Figure 15:
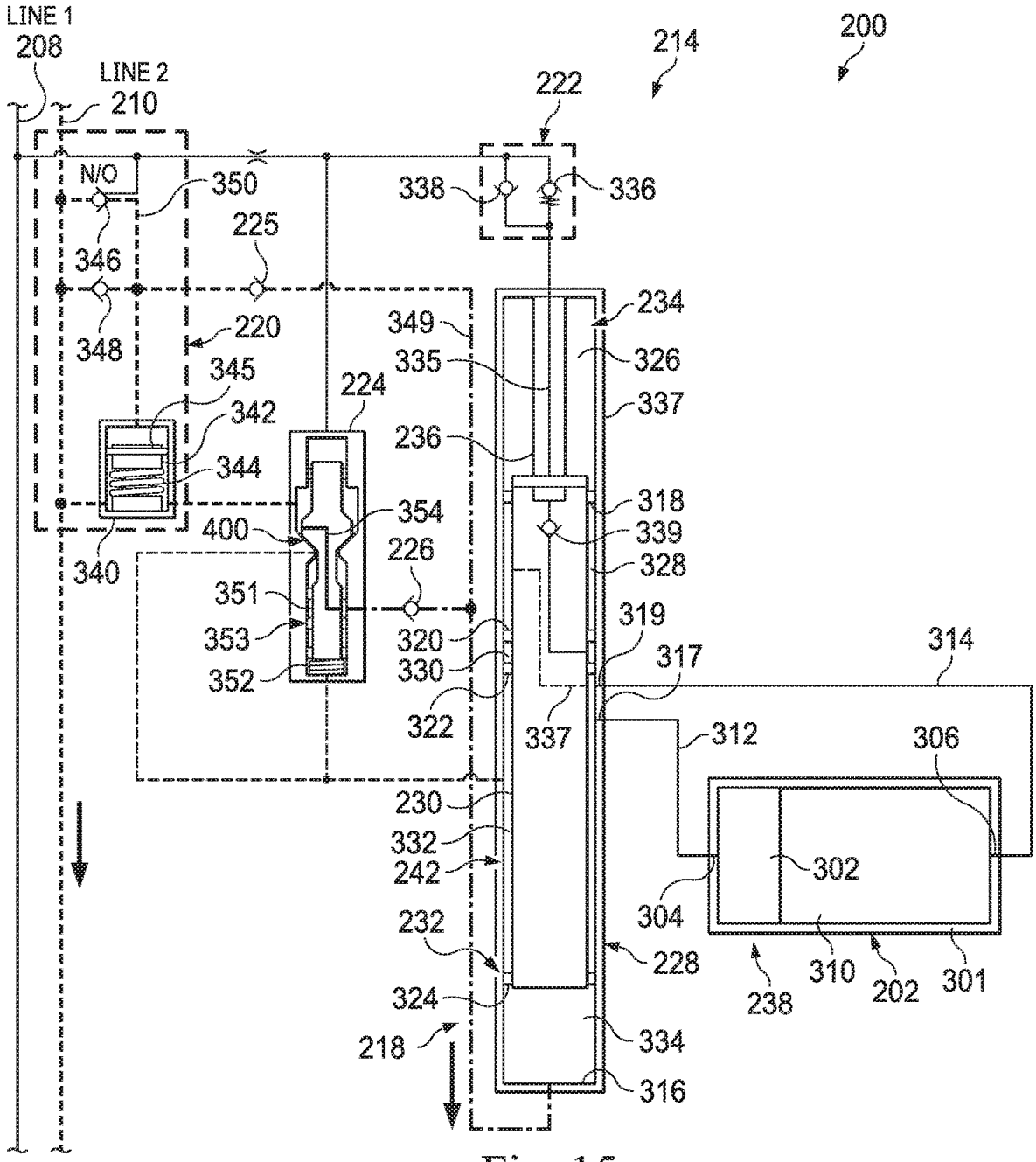
FIG. 15 is a schematic diagram of yet another configuration of the first controller and the first control valve of FIG. 3 during the second operating sequence, according to an example embodiment.

In FIG. 15, the primary line 208 is vented while the secondary line 210 remains pressurized. This venting causes hydraulic fluid to flow through the pilot-operated cartridge 224, through the reset check valve 226, and into the fifth chamber 334 of the indexing system 218. As the hydraulic fluid moves into the fifth chamber 334 of the indexing system 218, the piston 230 is moved upwards into the reset position 242 because the same level of pressure is no longer being applied at the first chamber 326.

While the primary line 208 is vented, the pilot-operated cartridge 224 remains closed, with the member 351 being held in the close position by the pressure in the secondary line 210. The force generated on the member 351 by the pressure in the secondary line 210 is greater than the force exerted by the spring 352, which allows the member 351 to remain in the closed position and the pilot-operated cartridge 224 to remain closed when the primary line 208 is vented. Further, the member 351 may also remain in the closed position during venting of the primary line 208 because the seal 400 created by the member 351 has a bigger sealing area than the primary line pilot port seal area.

Figure 16:
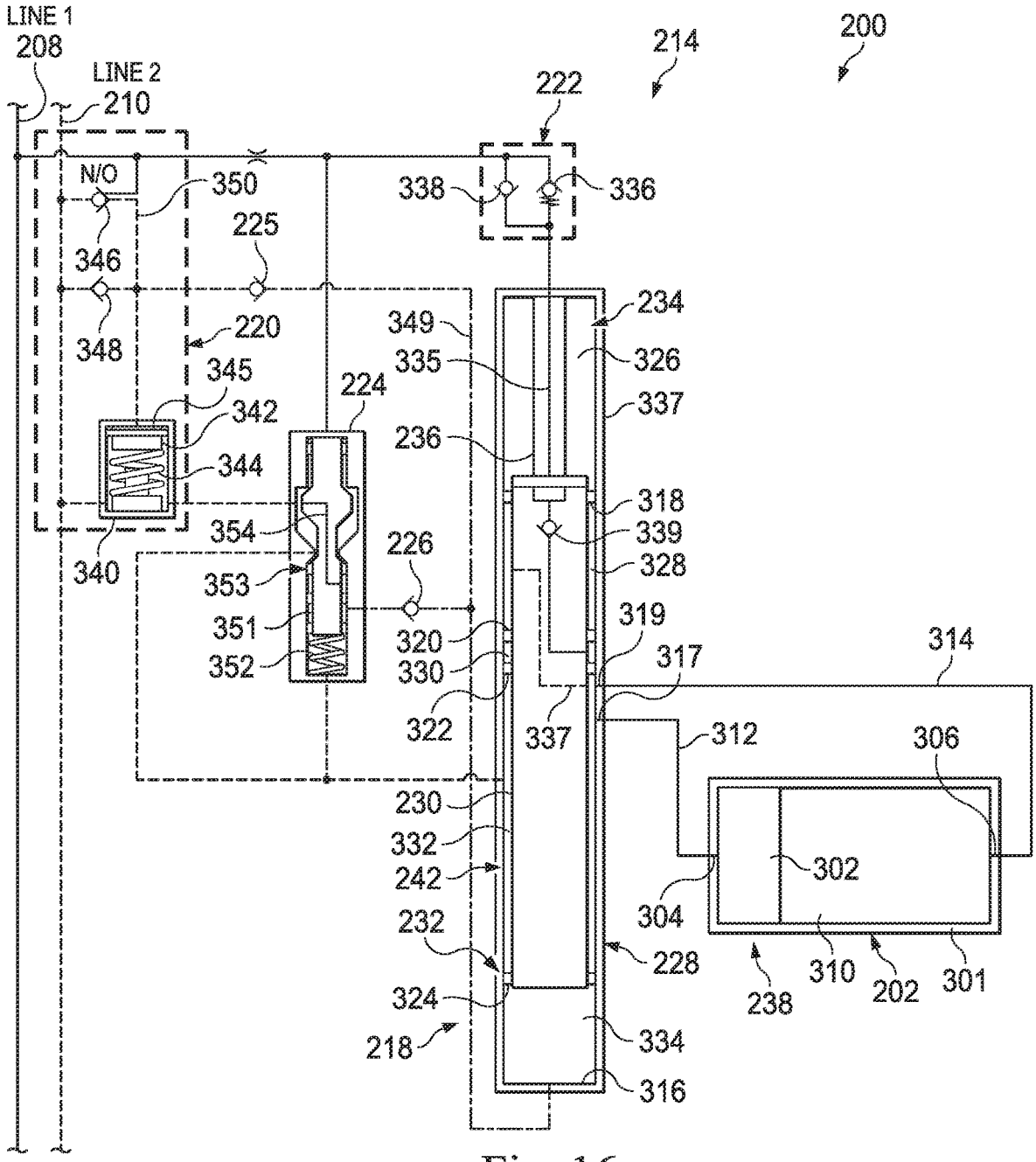
FIG. 16 is a schematic diagram of yet another configuration of the first controller and the first control valve of FIG. 3 during the second operating sequence, according to an example embodiment.

In FIG. 16, the secondary line 210 is then vented. This venting of the secondary line 210 completes the reset code for the resetting of the indexing system 218 and all controllers in the control system 200.

Thus, the reset code begins with the pressurization of the secondary line 210 while the primary line 208 is already pressurized. The reset code then includes the venting of the primary line 208 while the secondary line 210 remains pressurized. The reset code then ends with the venting of the secondary line 210. Although the reset code is described as being applied at a particular point during the operating sequence 250, this reset code may be applied at any point during the operation of the first controller 214 to reset the first controller 214, and thereby the control system 200.

Figure 17:
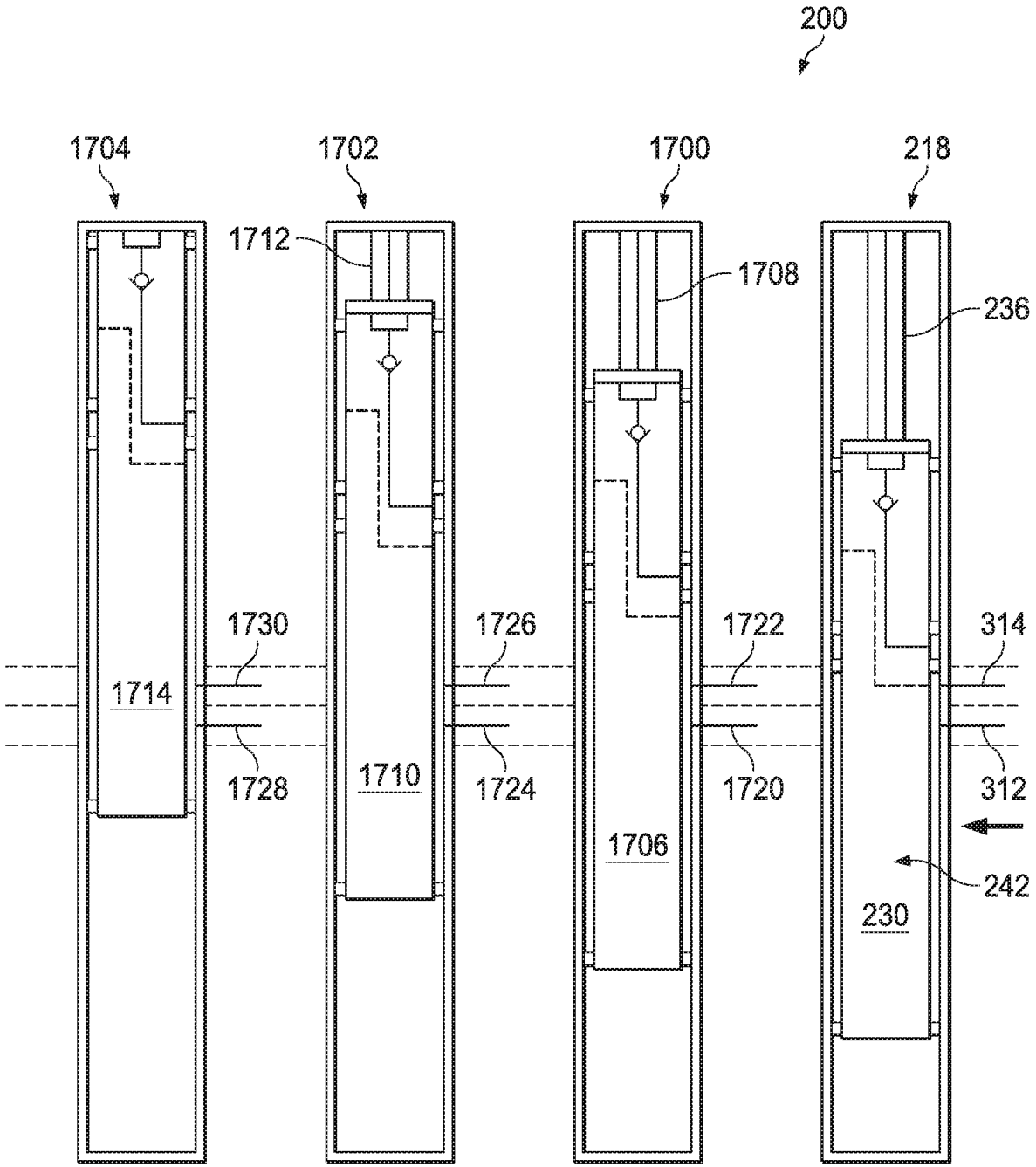
FIG. 17 is a schematic diagram of a configuration for multiple indexing systems used to control multiple control valves at the beginning of a third operating sequence, according to an example embodiment.

FIG. 17 is a schematic diagram of multiple indexing systems that may be used to control multiple control valves. In one or more embodiments, the control system described in FIGS. 2-16 may include additional controllers for controlling additional control valves. The configuration of control system 200 only requires the primary line 208 and the secondary line 210 to operate the additional controllers. Each additional controller may be implemented in a manner similar to the first controller 214 described in FIGS. 2-16.

In one or more embodiments, the control system 200 may include the indexing system 218, a second indexing system 1700, a third indexing system 1702, and a fourth indexing system 1704. Of course, in other embodiments, the control system 200 may include up to n index systems in addition to the indexing system 218 for an additional n controllers in addition to the first controller 214. The second indexing system 1700 includes a second piston 1706 and a second reset guide member 1708. The third indexing system 1702 includes a third piston 1710 and a third reset guide member 1712. The fourth indexing system 1704 includes a fourth piston 1714 but does not include a reset guide member.

The piston 230, the second piston 1706, the third piston 1710, and the fourth piston 1714 are all shown in FIG. 17 in their reset positions. The reset guide member 236, the second reset guide member 1708, and the third reset guide member 1712, and the absence of a reset guide member determine how far, from a top of the corresponding housing in the corresponding indexing system, the piston 230, the second piston 1706, the third piston 1710, and the fourth piston 1714, are positioned when these pistons are in their reset positions.

Each of these indexing systems may be part of a different controller. Further, each of these indexing systems may be fluidly connected to a different control valve (not shown in this view). For example, the indexing system 218 is fluidly connected to the first control valve 202, as described in FIGS. 2-16, through close line 312 and open line 314. The second indexing system 1700 is fluidly connected to a second control valve through a close line 1720 and an open line 1722. The third indexing system 1702 is fluidly connected to a third control valve through a close line 1724 and an open line 1726. The fourth indexing system 1704 is fluidly connected to fourth second control valve through a close line 1728 and an open line 1730.

FIGS. 18-26 are schematic diagrams describing one example implementation of the indexing of the piston 230, the second piston 1706, the third piston 1710, and the fourth piston 1714 from FIG. 17 based on the operating sequence 250 used to pressurize the primary line 208 and the secondary line 210, to thereby control operation of the control valves with which these pistons are associated. For example, each time that the primary line 208 is pressurized, at least one of the pistons moves.

Figure 18:
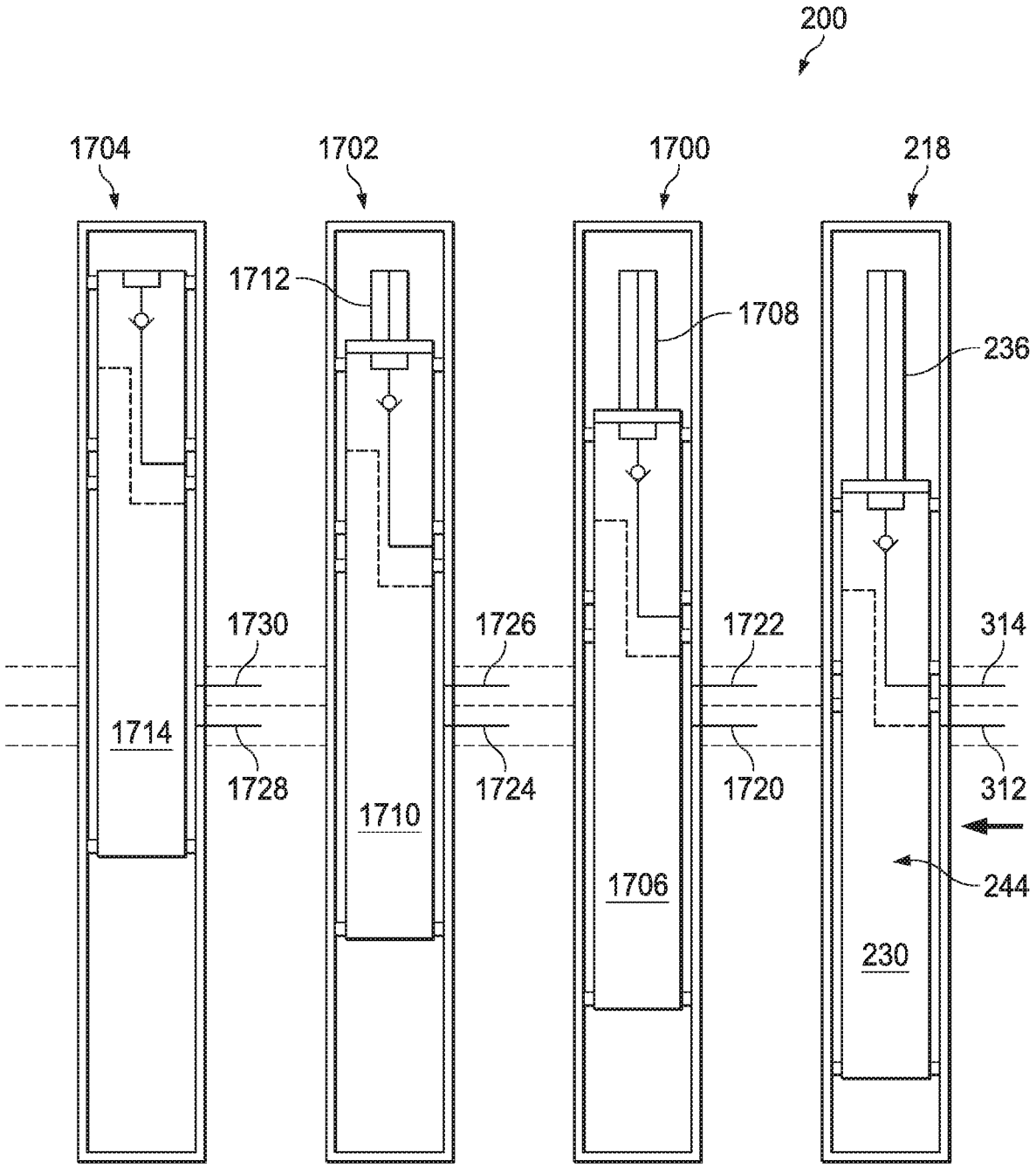
FIG. 18 is a schematic diagram of another configuration for the multiple indexing systems of FIG. 17 during the third operating sequence, according to an example embodiment.

In FIG. 18, the piston 230 is moved downwards from the reset position to a close position. At the same time, the second piston 1706, the third piston 1710, and the fourth piston 1714 are also moved downwards but into blank positions such that the corresponding control valve for each of the second piston 1706, the third piston 1710, and the fourth piston 1714 remains equalized.

Figure 19:
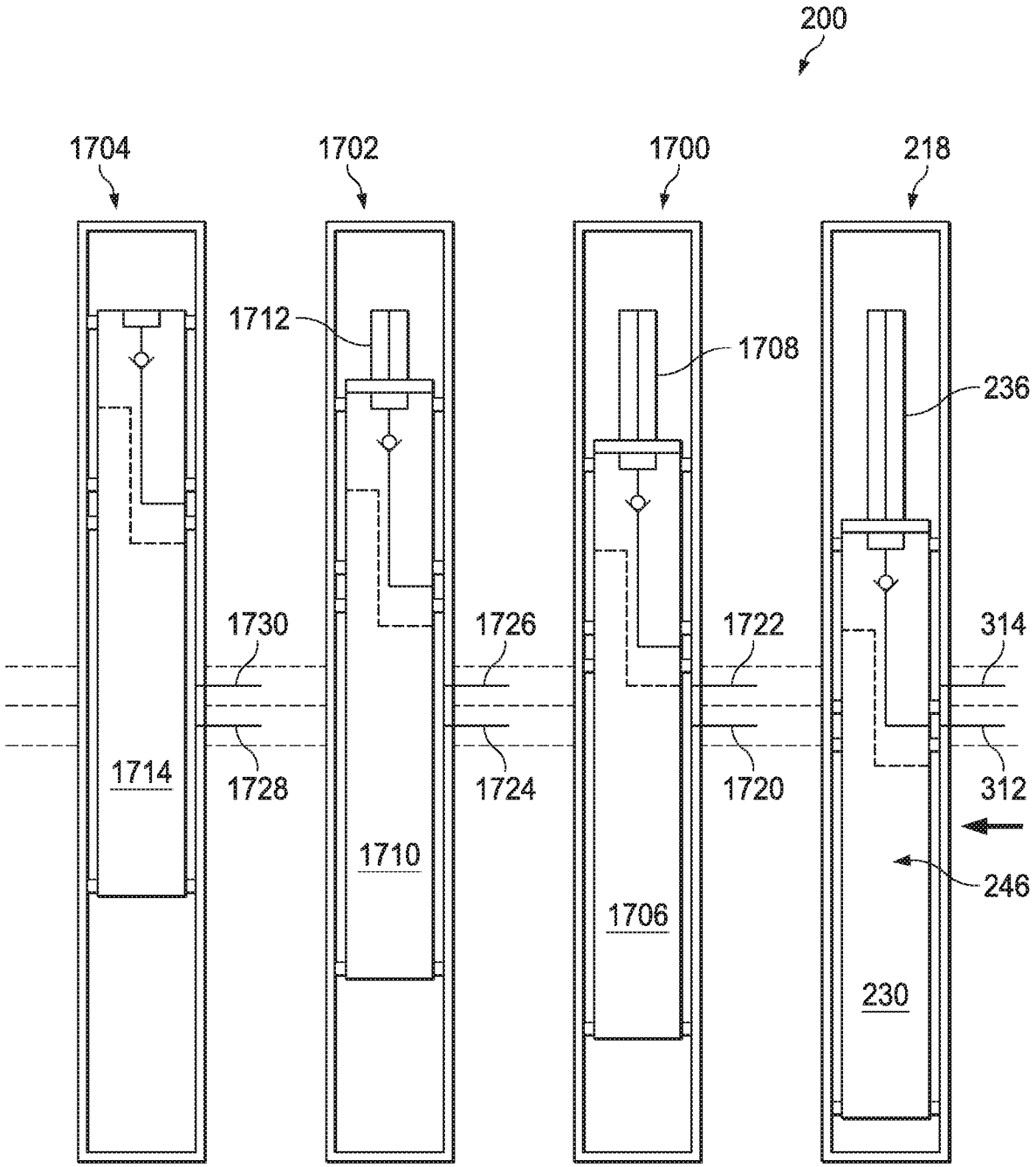
FIG. 19 is a schematic diagram of another configuration for the multiple indexing systems of FIG. 17 during the third operating sequence, according to an example embodiment.

In FIG. 19, the piston 230 is moved further downwards from the close position to an open position. At the same time, the second piston 1706, the third piston 1710, and the fourth piston 1714 are also moved downwards but into blank positions such that the corresponding control valve for each of the second piston 1706, the third piston 1710, and the fourth piston 1714 remains equalized.

Figure 20:
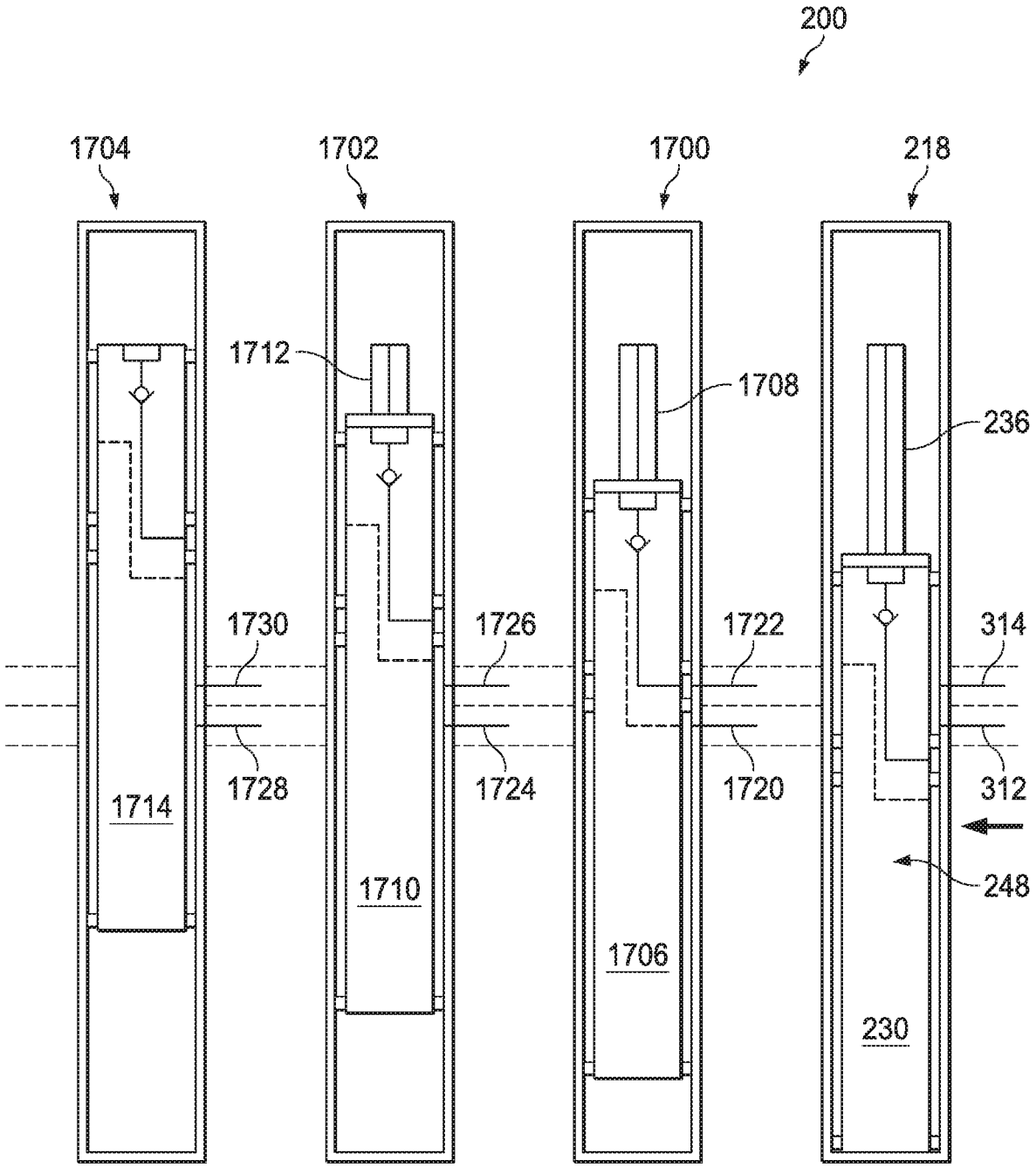
FIG. 20 is a schematic diagram of another configuration for the multiple indexing systems of FIG. 17 during the third operating sequence, according to an example embodiment.

In FIG. 20, the piston 230 is moved further downwards from the open position to a blank position. The piston 230 will no longer be able to move further downwards. At the same time, the second piston 1706 is moved further downwards from the blank position to a closed position. The third piston 1710 and the fourth piston 1714 are also moved downwards but into blank positions such that the corresponding control valve for each of the third piston 1710 and the fourth piston 1714 remains equalized.

Figure 21:
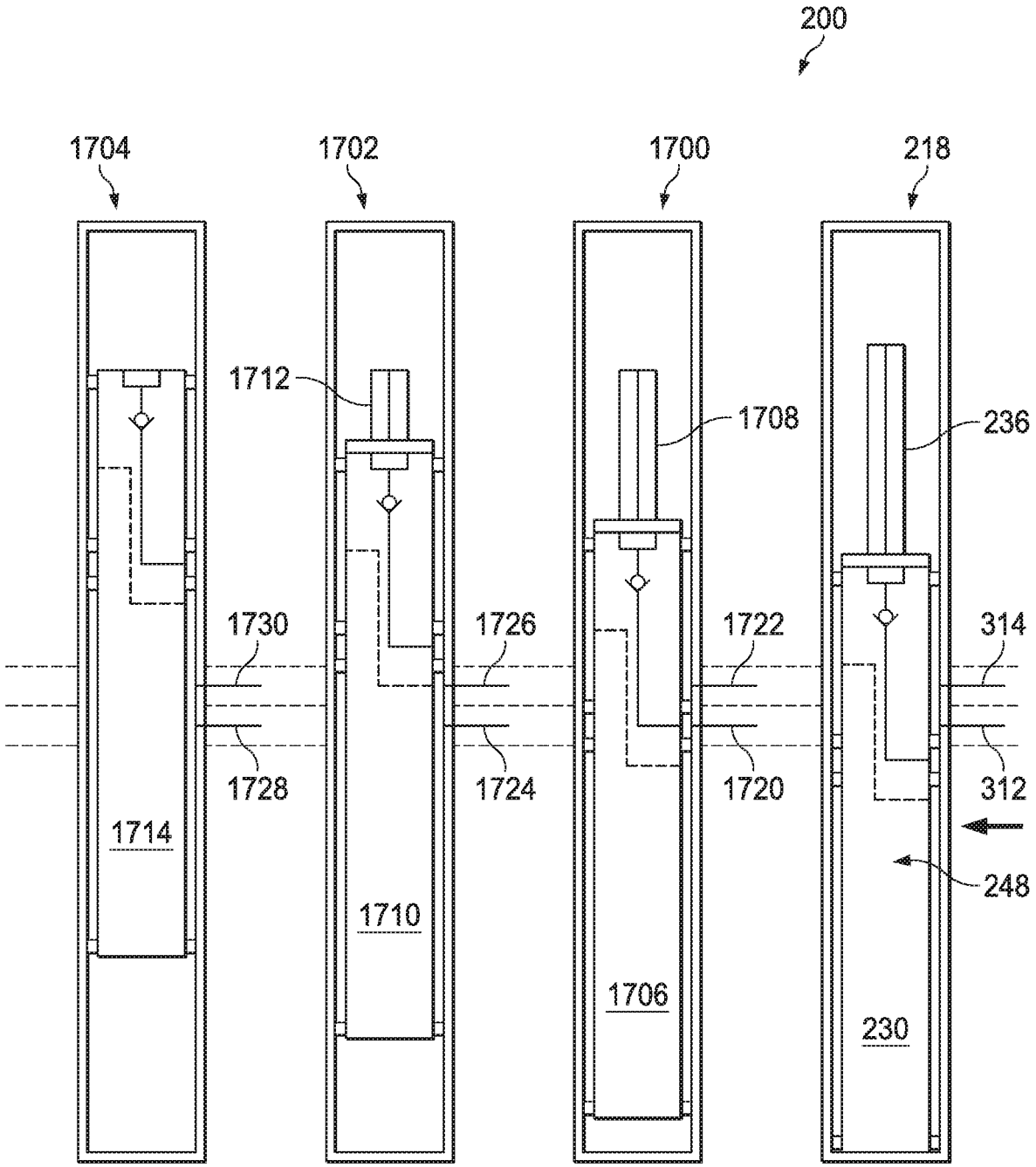
FIG. 21 is a schematic diagram of another configuration for the multiple indexing systems of FIG. 17 during the third operating sequence, according to an example embodiment.

In FIG. 21, the piston 230 remains in the blank position, but the second piston 1706 moves further downwards from the close position to an open position. At the same time, the third piston 1710 and the fourth piston 1714 are also moved downwards but into blank positions such that the corresponding control valve for each of the third piston 1710 and the fourth piston 1714 remains equalized.

Figure 22:
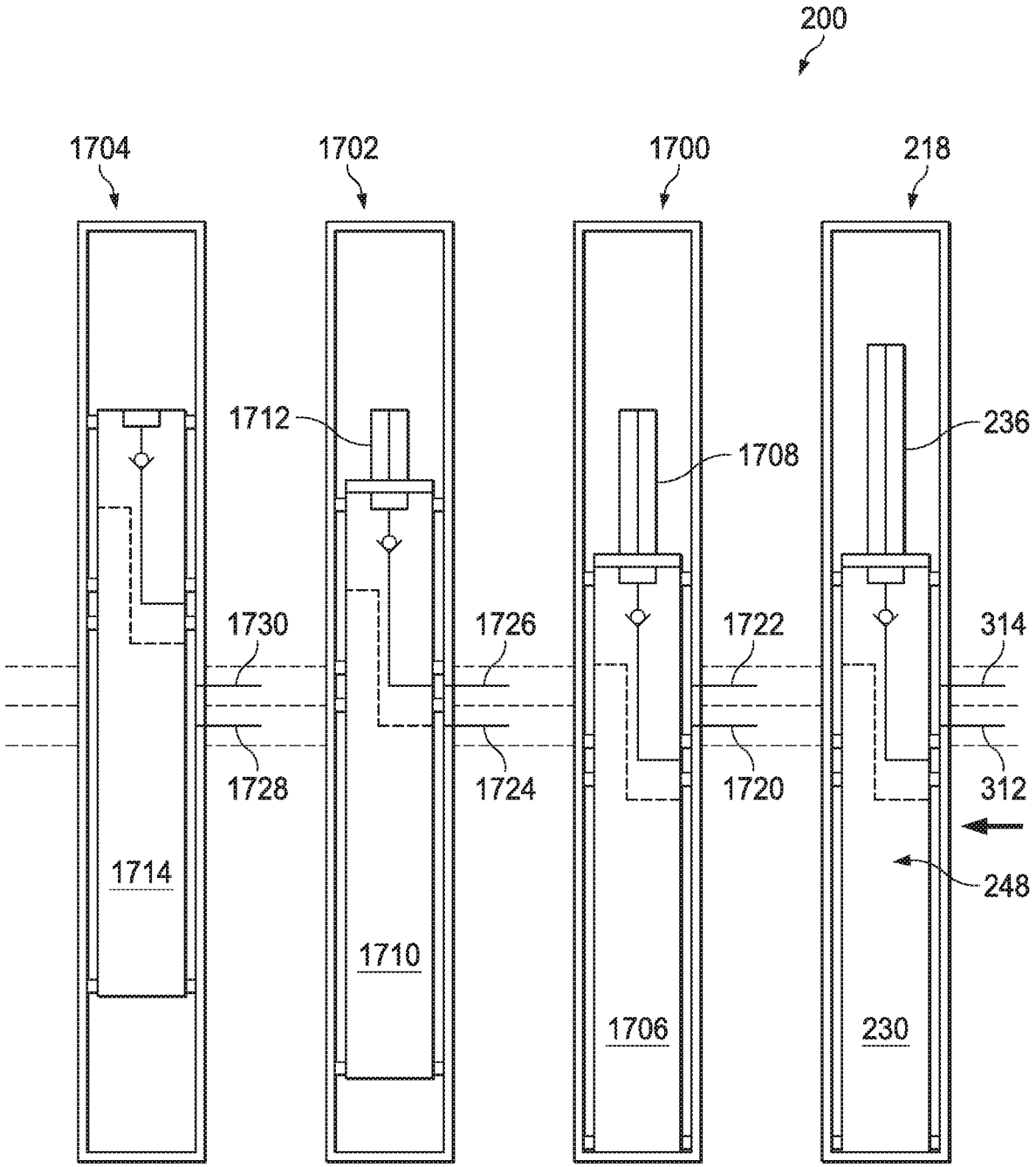
FIG. 22 is a schematic diagram of another configuration for the multiple indexing systems of FIG. 17 during the third operating sequence, according to an example embodiment.

In FIG. 22, the piston 230 remains in the blank position, but the second piston 1706 moves further downwards from the open position to a blank position. The second piston 1706 will now no longer be able to move further downwards. At the same time, the third piston 1710 is moved further downwards from the blank position to a closed position. The fourth piston 1714 is moved downwards but into a blank position such that the corresponding control valve for the fourth piston 1714 remains equalized.

Figure 23:
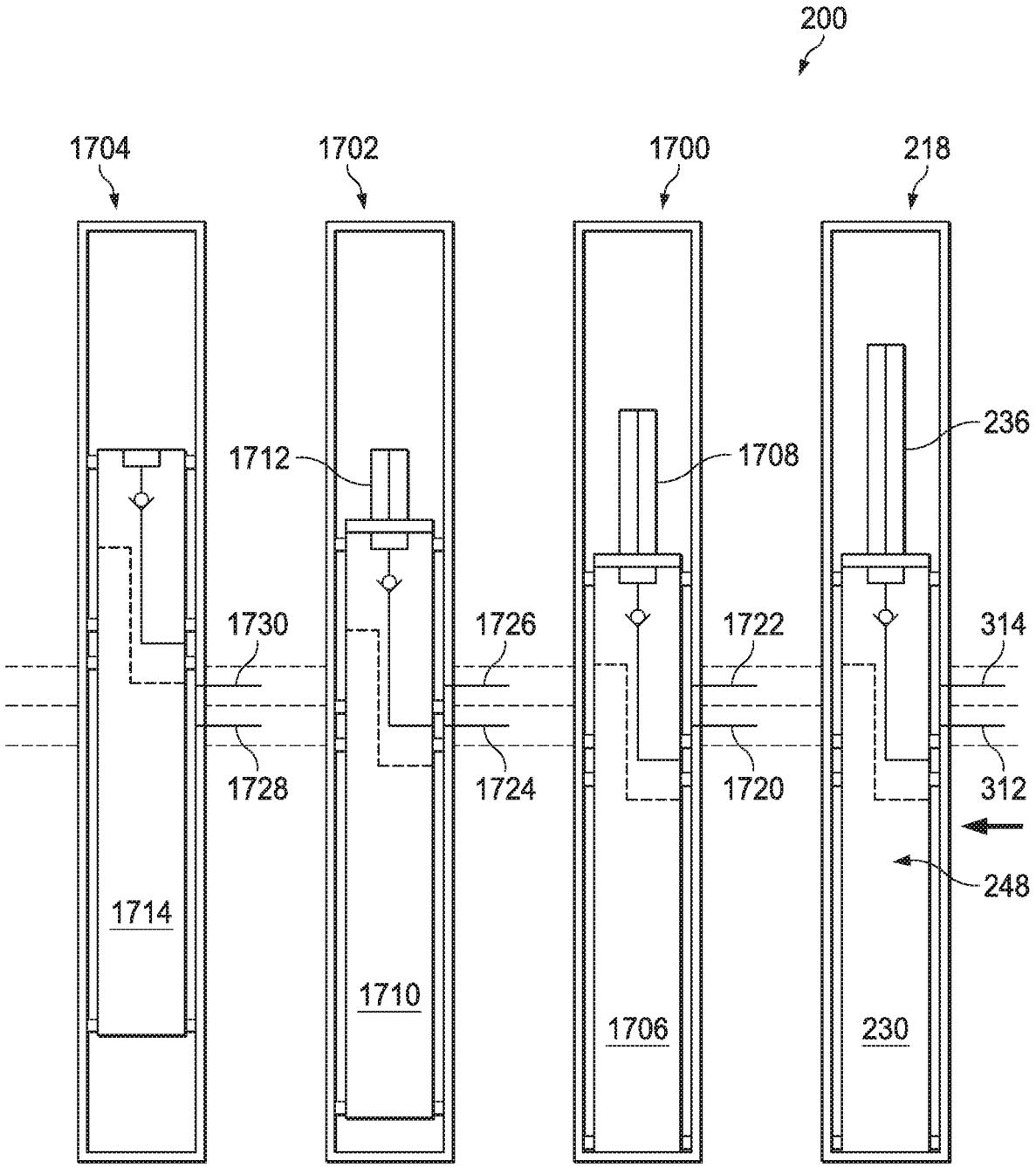
FIG. 23 is a schematic diagram of another configuration for the multiple indexing systems of FIG. 17 during the third operating sequence, according to an example embodiment.

In FIG. 23, the piston 230 and the second piston 1706 remain in their blank positions, but the third piston 1710 moves further downwards from the close position to an open position. The fourth piston 1714 is moved downwards but into a blank position such that the corresponding control valve for the fourth piston 1714 remains equalized.

Figure 24:
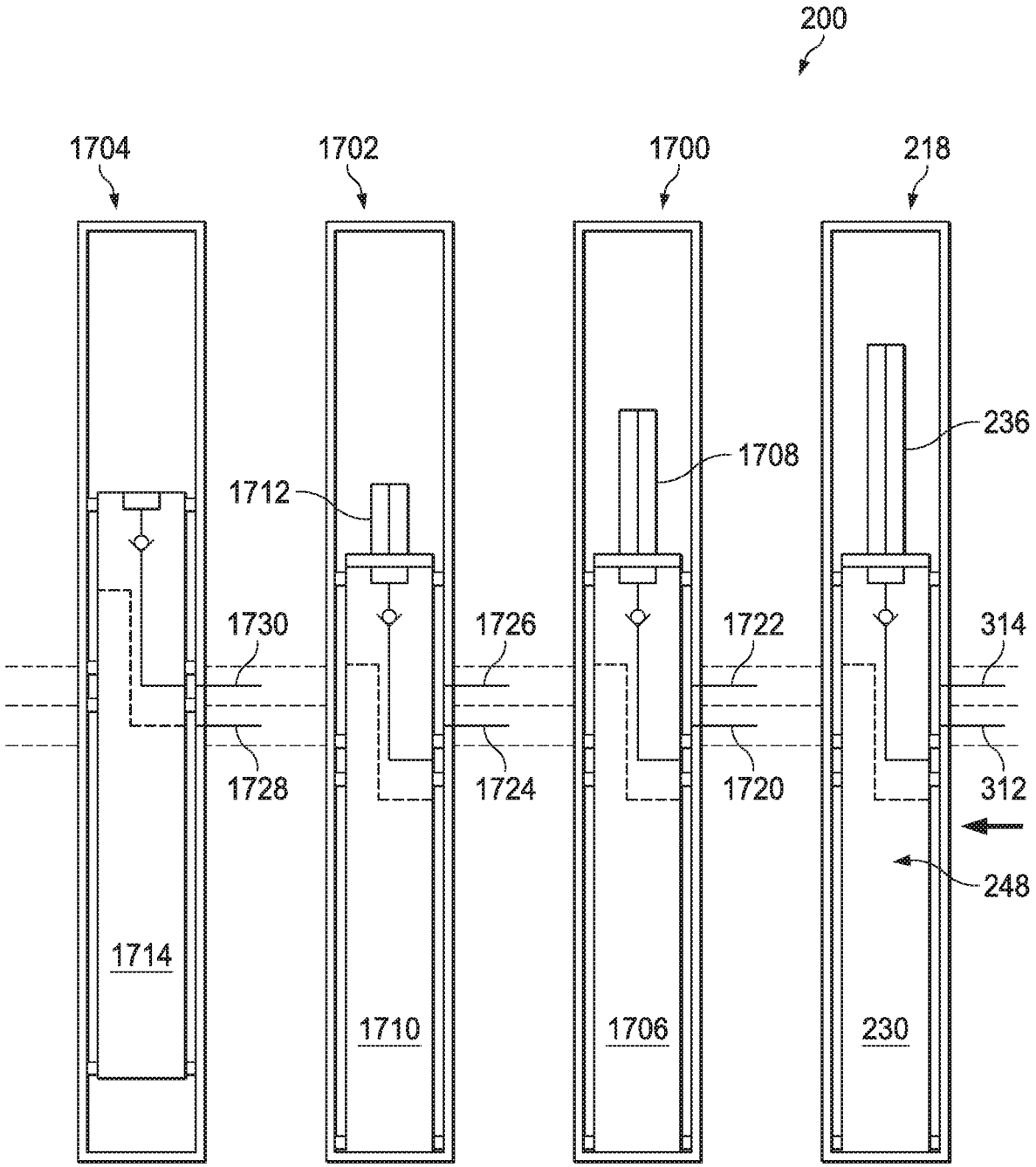
FIG. 24 is a schematic diagram of another configuration for the multiple indexing systems of FIG. 17 during the third operating sequence, according to an example embodiment.

In FIG. 24, the piston 230 and the second piston 1706 remain in their blank positions, but the third piston 1710 moves further downwards from the open position to a blank position. The third piston 1710 will now no longer be able to move further downwards. At the same time, the fourth piston 1714 is also moved downwards into a close position.

Figure 25:
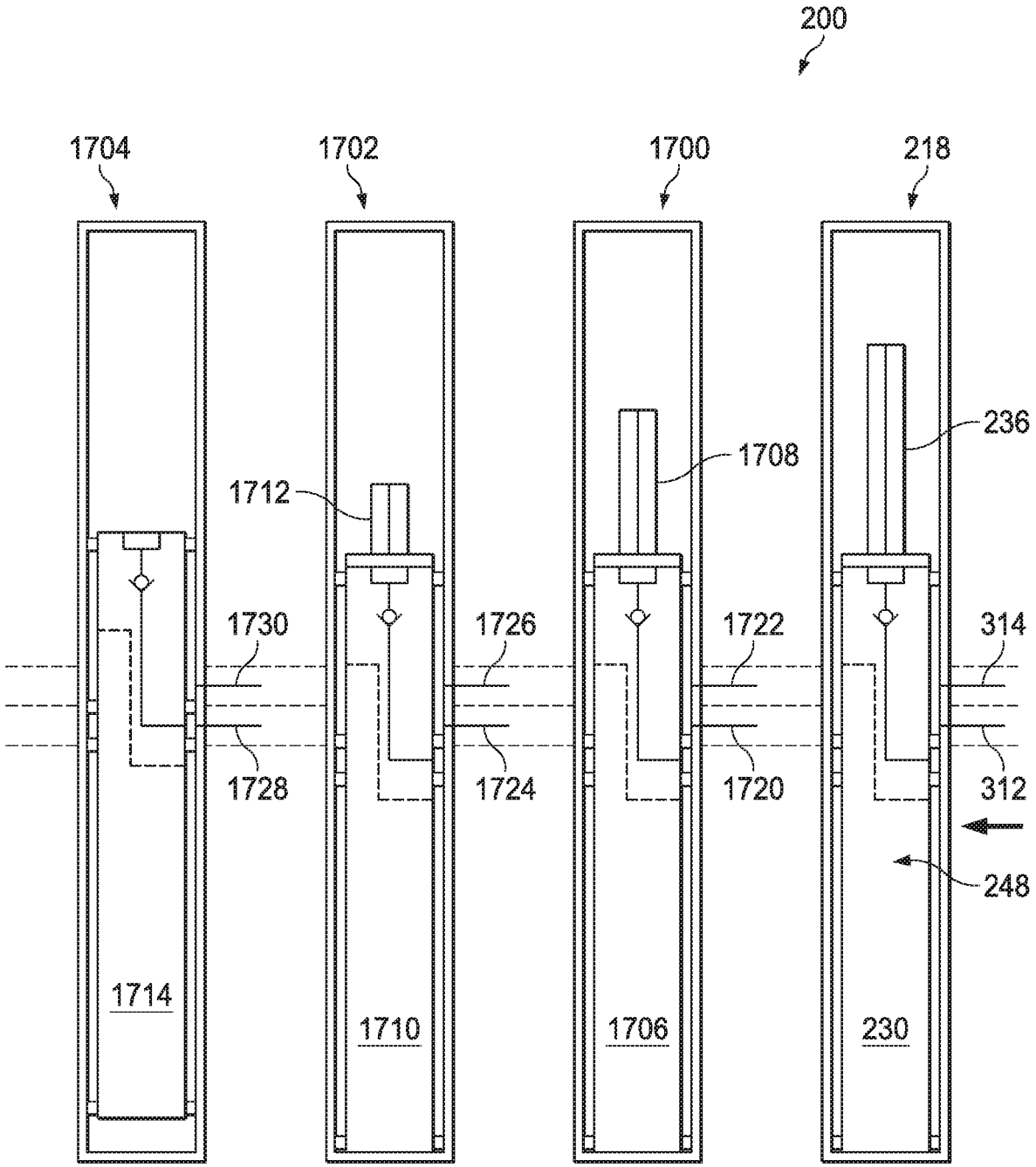
FIG. 25 is a schematic diagram of another configuration for the multiple indexing systems of FIG. 17 during the third operating sequence, according to an example embodiment.

In FIG. 25, the piston 230, the second piston 1706, and the third piston 1710 remain in their blank positions, but the fourth piston 1714 moves downwards from the close position into an open position.

Figure 26:
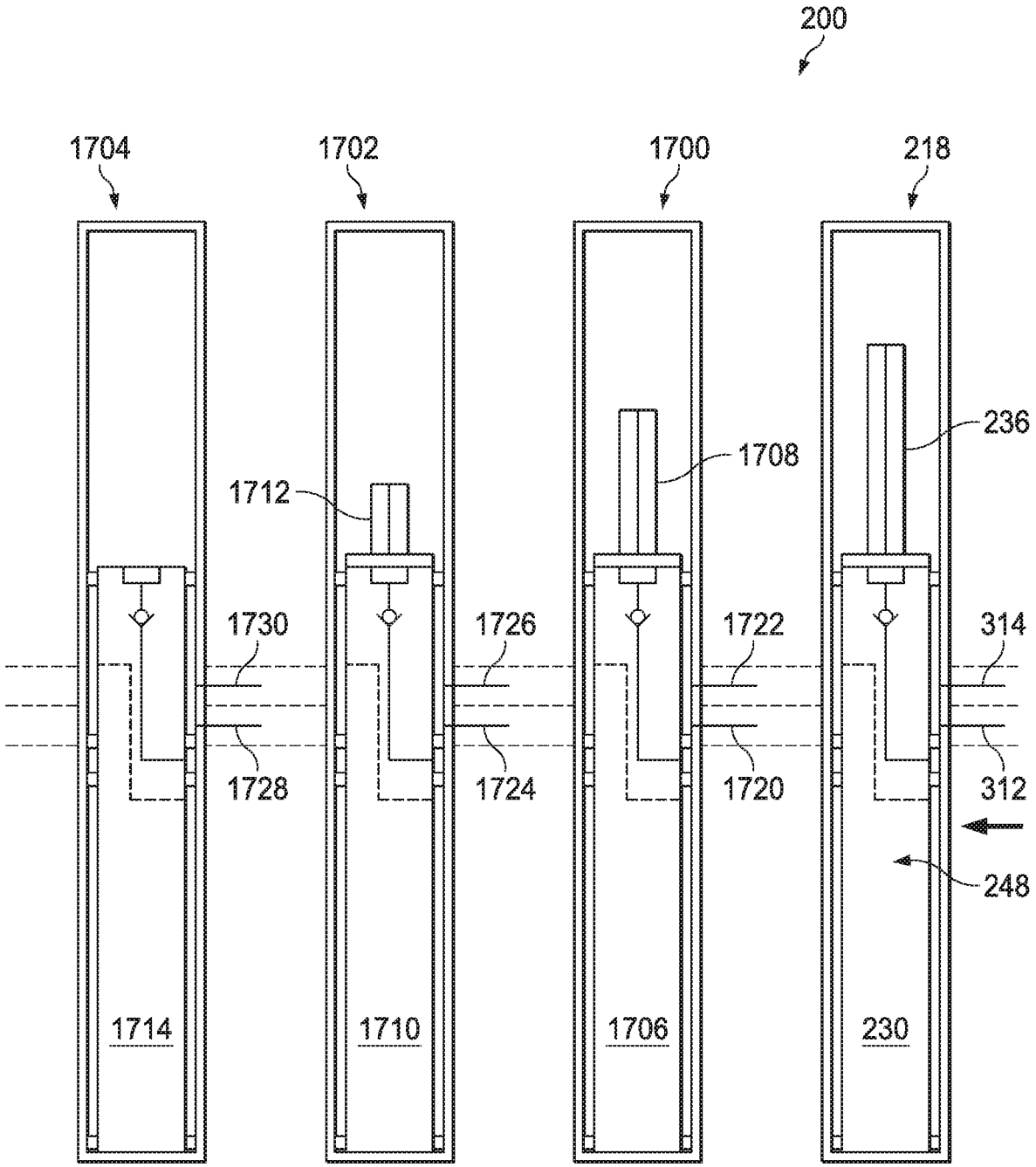
FIG. 26 is a schematic diagram of another configuration for the multiple indexing systems of FIG. 17 during the third operating sequence, according to an example embodiment.

In FIG. 26, the piston 230, the second piston 1706, and the third piston 1710 remain in their blank positions, but the fourth piston 1714 moves downwards from the open position into a blank position. At this point, each of the piston 230, the second piston 1706, and the third piston 1710, and the fourth piston 1714 have moved through all positions. The control system 200 may now reset to move all four pistons substantially simultaneously back into their respective reset positions, as shown in FIG. 17.

Figure 27:
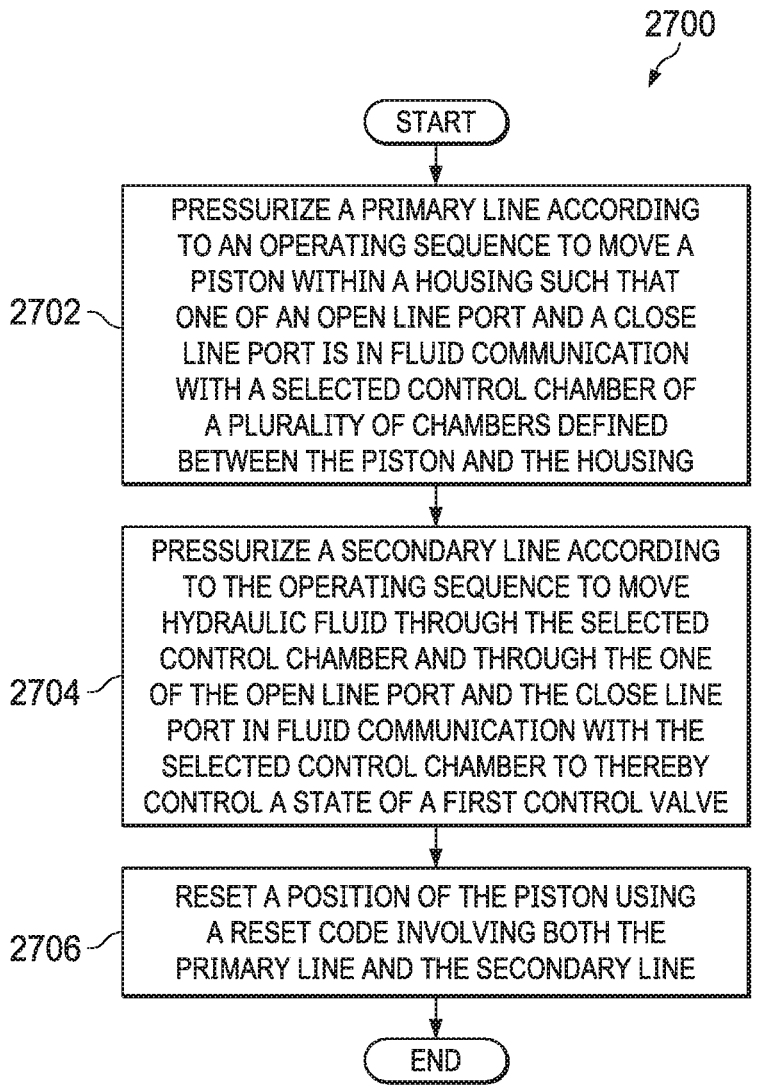
FIG. 27 is a flowchart illustration of a method for controlling one or more control valves, according to an example embodiment.

FIG. 27 is a flowchart illustration of a method 2700 for controlling one or more control valves, with continuing reference to FIGS. 2-16. The method 2700 includes, at step 2702, pressurizing the primary line 208 according to the operating sequence 250 to move the piston 230 within the housing 228 such that one of the open line port 319 and the close line port 317 is in fluid communication with a selected control chamber of the plurality of chambers 234 defined between the piston 230 and the housing 228. The selected control chamber may be either the fourth chamber 332 (e.g. a first control chamber) or the second chamber 328 (e.g. a second control chamber).

At step 2704, the secondary line 210 is pressurized according to the operating sequence 250 to move hydraulic fluid through the selected control chamber and through the one of the open line port 319 and the close line port 317 in fluid communication with the selected control chamber to thereby control a state of the first control valve 202. At step 2706, a position of the piston 230 is reset using a reset code involving both the primary line 208 and the secondary line 210. As previously described, the reset code is initiated by pressurizing the primary line 208 and then pressurizing the secondary line 210. Next, the primary line 208 is vented while the secondary line 210 remains pressurized, which moves the piston 230 into the reset position 242. The reset code may conclude with the secondary line 210 being vented.

Figure 28:
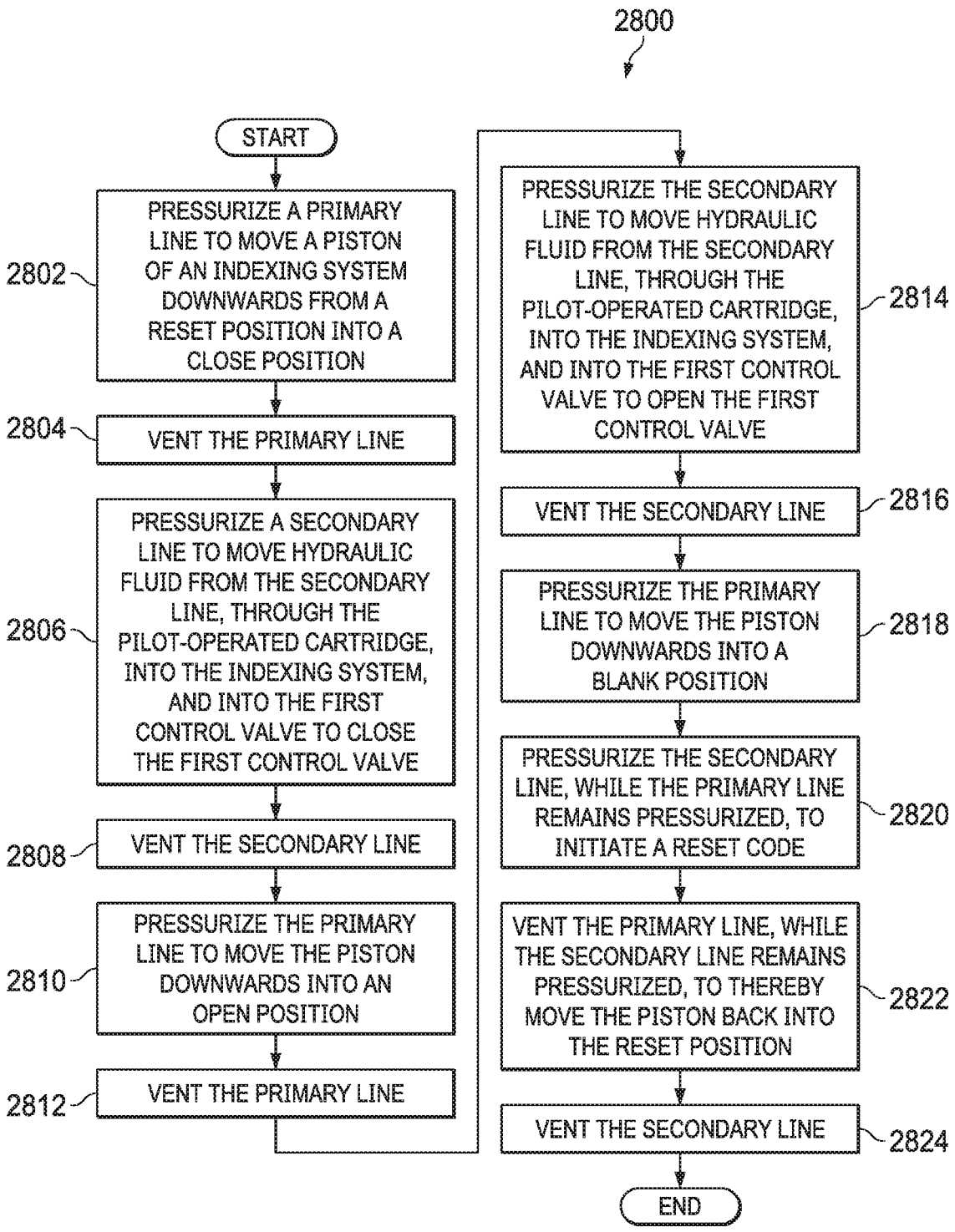
FIG. 28 is a flowchart illustration of a method for controlling one or more control valves, according to an example embodiment.

FIG. 28 is a flowchart illustration of a method 2800 for controlling one or more control valves using an operating sequence 250, with continuing reference to FIGS. 2-16. The method 2700 includes, at step 2802, pressurizing the primary line 208 to move the piston 230 downwards from a reset position 242 into a close position 244. Next, at step 2804, the primary line 208 is vented. At step 2806, the secondary line 210 is pressurized to move hydraulic fluid from the secondary line 210, through the pilot-operated cartridge 224, into the indexing system 218, and into the first control valve 202 to close the first control valve 202.

At step 2808, the secondary line 210 is vented. At step 2810, the primary line 208 is pressurized to move the piston 230 downwards into an open position 246. At step 2812, the primary line 208 is again vented. At step 2814, the secondary line 210 is pressurized to move hydraulic fluid from the secondary line 210, through the pilot-operated cartridge 224, into the indexing system 218, and into the first control valve 202 to open the first control valve 202. At step 2816, the secondary line 210 is again vented.

At step 2818, the primary line 208 is pressurized to move the piston 230 into the blank position 248. At step 2820, the secondary line 210 is pressurized, while the primary line 208 remains pressurized, to initiate a reset code. At step 2822, the primary line 208 is vented, while the secondary line 210 remains pressurized, to thereby move the piston 230 back into the reset position 242. At step 2824, the secondary line 210 is vented, with the process terminating thereafter.

Thus, the different embodiments describe a control system for controlling one or more control valves. In one or more embodiments, the control system 200 described in FIGS. 2-16 provides a different configuration for a purely hydraulic mechanism that may be used to control one or more control valves. The control system 200 may use only the primary line 208 and the secondary line 210 to control any number of control valves. For example, these two hydraulic lines may be used to control an unlimited number of control valves. The primary line 208 may be used to index the piston of the indexing system corresponding to each of the control valves, while the secondary line 210 may be used to supply the pressure needed to change the state of the control valves. The configuration of the control system 200 allows the various controllers to be reset at any time using a reset code without affecting the state of the control valves.

As described, the control system 200 may reduce the total number of hydraulic lines that extend from the surface of the well at, for example, the semi-submersible platform 102, to the set of control valves 201. Thus, the cross-sectional area of the tubing string 126 or other tubular extending between the surface and the set of control valves 201 may be reduced. Moreover, as the control system 200 does not require mechanical components that rotate, which may wear over time, the life of these types of control systems may be extended.

Thus, an apparatus includes a first housing, a first piston, a first plurality of seals, a primary line, and a secondary line. The first housing has an open line port and a close line port. The first piston is located within the first housing and movable within the first housing, wherein a control channel extends through the first piston. The first plurality of seals is fixedly attached to the first piston such that the first plurality of seals defines a first plurality of chambers between the first piston and the first housing. The first plurality of chambers includes an auxiliary chamber, a first control chamber, and a second control chamber. The control channel fluidly connects the first control chamber and the second control chamber. The primary line and the secondary line are fluidly connected to the first plurality of chambers. Pressurization of the primary line according to an operating sequence moves the first piston within the first housing such that one of the open line port and the close line port is in fluid communication with a selected chamber of the first control chamber and the second control chamber and the other of the open line port and the close line port is in fluid communication with the auxiliary chamber. Pressurization of the secondary line according to the operating sequence moves hydraulic fluid into the selected chamber and through the one of the open line port and the close line port in fluid communication with the selected chamber.

Simultaneous pressurization of the primary line and the secondary line followed by venting of the primary line, while the secondary line remains pressurized, resets a position of the first piston within the first housing.

The first piston is movable into a plurality of index positions within the first housing and wherein the plurality of index positions includes a reset position, a close position, and an open position.

Movement of the first piston into the close position by pressurization of the primary line puts the close line port in fluid communication with the first control chamber.

Movement of the first piston into the open position by pressurization of the primary line puts the open line port in fluid communication with the second control chamber of the first plurality of chambers.

The apparatus further includes a first control valve.

When the close line port is in fluid communication with the first control chamber, pressurization of the secondary line moves the hydraulic fluid into the first control chamber, through the close line port, and into a close line that fluidly connects the close line port to the first control valve to thereby switch the first control valve to a closed state.

When the open line port is in fluid communication with the second control chamber, pressurization of the secondary line moves the hydraulic fluid into the first control chamber, through the control channel within the first piston, into the second control chamber, through the open line port, and into an open line that fluidly connects the open line port to the first control valve to thereby switch the first control valve to an open state.

The first piston is moved into the reset position when the primary line is vented after the simultaneous pressurization of the primary line and the secondary line, while the secondary line remains pressurized.

The open line port and the close line port are in fluid communication with a same chamber of the first plurality of chambers when the first piston is in the reset position and wherein the open line port and the close line port are in fluid communication with different chambers of the first plurality of chambers within the first housing when the first piston is in the close position and the open position.

The apparatus further includes an open line in fluid communication with the open line port and a close line in fluid communication with the close line port, wherein the open line and the close line are configured for fluid connection to a first control valve.

The first plurality of chambers includes an index chamber.

The apparatus further includes a relief manifold that controls a flow of the hydraulic fluid from the primary line into an index chamber and a metering system that controls a flow of the hydraulic fluid between the primary line and the secondary line to thereby control a buildup of pressure in the relief manifold, wherein the metering system includes a second housing, a second piston located within the second housing, a pilot-operated valve, and a check valve.

The apparatus further includes a check valve disposed within the first piston, wherein the check valve controls a return of the hydraulic fluid from the auxiliary chamber of the first plurality of chambers into an index chamber of the first plurality of chambers.

The apparatus further includes a pilot-operated cartridge that includes a member and a spring, wherein pressurization of the primary line moves the hydraulic fluid into the pilot-operated cartridge, thereby moving the member in a first direction to compress the spring and close the pilot-operated cartridge; and wherein venting the primary line moves the member in a second direction opposite the first direction to open the pilot-operated cartridge.

The first plurality of chambers includes a reset chamber.

The apparatus further includes a reset check valve that controls a flow of the hydraulic fluid from the pilot-operated cartridge back into the reset chamber to enable the first piston to be reset; and an anti-reset check valve that allows the hydraulic fluid from the reset chamber to move into a metering system when the first piston is not being reset.

The apparatus further includes a reset guide member secured to the first piston within the first housing and used to guide the first piston into a reset position within the first housing.

The apparatus further includes a second housing, a second piston, and a second plurality of seals. The second piston is located within the second housing and is movable within the second housing. The second plurality of seals is fixedly attached to the second piston such that the second plurality of seals defines a second plurality of chambers between the second piston and the second housing. The primary line and the secondary line are fluidly connected to the second plurality of chambers and are used to control a first control valve by moving the first piston within the first housing and to control a second control valve by moving the second piston within the second housing.

The first piston has a fixed rotational orientation relative to the first housing.

Thus, a method for controlling at least one control valve is provided. A primary line is pressurized according to an operating sequence to move a first piston within a first housing such that one of an open line port and a close line port is in fluid communication with a selected chamber of a first control chamber and a second control chamber of a first plurality of chambers defined between the first piston and the first housing. A secondary line is pressurized according to the operating sequence to move hydraulic fluid through the selected chamber and through the one of the open line port and the close line port in fluid communication with the selected chamber to thereby control a state of a first control valve. The primary line and the secondary line are pressurized simultaneously according to the operating sequence. The primary line is vented, while the secondary line remains pressurized, to reset a position of the first piston within the first housing.

Pressurizing the primary line includes pressurizing the primary line according to the operating sequence to move the first piston in a first direction into a close position such that the close line port is in fluid communication with the first control chamber.

Pressurizing the secondary line includes pressurizing the secondary line according to the operating sequence to move the hydraulic fluid into the first control chamber, through the close line port, and into a close line that fluidly connects the close line port to the first control valve to thereby switch the first control valve to a closed state.

Pressurizing the primary line includes pressurizing the primary line according to the operating sequence to move the first piston in a first direction into an open position such that the open line port is in fluid communication with the second control chamber.

Pressurizing the secondary line includes pressurizing the secondary line according to the operating sequence to move the hydraulic fluid moves into the first control chamber, through a control channel within the first piston, into the second control chamber, through the open line port, and into an open line that fluidly connects the open line port to the first control valve to thereby switch the first control valve to an open state.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

In several example embodiments, while different steps, processes, and procedures are described as appearing as distinct acts, one or more of the steps, one or more of the processes, and/or one or more of the procedures could also be performed in different orders, simultaneously and/or sequentially. In several example embodiments, the steps, processes and/or procedures could be merged into one or more steps, processes and/or procedures.

It is understood that variations may be made in the foregoing without departing from the scope of the disclosure. Furthermore, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several example embodiments have been described in detail above, the embodiments described are example only and are not limiting, and those skilled in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. An apparatus comprising:

a first housing having an open line port and a close line port;

a first piston located within the first housing and movable within the first housing, wherein a control channel extends through the first piston;

a first plurality of seals fixedly attached to the first piston such that the first plurality of seals defines a first plurality of chambers between the first piston and the first housing, wherein the first plurality of chambers includes an auxiliary chamber, a first control chamber, and a second control chamber; and wherein the control channel fluidly connects the first control chamber and the second control chamber;

a primary line fluidly connected to the first plurality of chambers, wherein pressurization of the primary line according to an operating sequence moves the first piston within the first housing such that one of the open line port and the close line port is in fluid communication with a selected chamber of the first control chamber and the second control chamber and the other of the open line port and the close line port is in fluid communication with the auxiliary chamber; and a secondary line fluidly connected to the first plurality of chambers, wherein pressurization of the secondary line according to the operating sequence moves hydraulic fluid into the selected chamber and through the one of the open line port and the close line port in fluid communication with the selected chamber.

2. The apparatus of claim 1, wherein simultaneous pressurization of the primary line and the secondary line followed by venting of the primary line, while the secondary line remains pressurized, resets a position of the first piston within the first housing.

3. The apparatus of claim 1, wherein the first piston is movable into a plurality of index positions within the first housing and wherein the plurality of index positions includes a reset position, a close position, and an open position.

4. The apparatus of claim 3, wherein movement of the first piston into the close position by pressurization of the primary line puts the close line port in fluid communication with the first control chamber.

5. The apparatus of claim 4, wherein movement of the first piston into the open position by pressurization of the primary line puts the open line port in fluid communication with the second control chamber of the first plurality of chambers.

6. The apparatus of claim 5 further comprising:

a first control valve, wherein, when the close line port is in fluid communication with the first control chamber, pressurization of the secondary line moves the hydraulic fluid into the first control chamber, through the close line port, and into a close line that fluidly connects the close line port to the first control valve to thereby switch the first control valve to a closed state; and wherein, when the open line port is in fluid communication with the second control chamber, pressurization of the secondary line moves the hydraulic fluid into the first control chamber, through the control channel within the first piston, into the second control chamber, through the open line port, and into an open line that fluidly connects the open line port to the first control valve to thereby switch the first control valve to an open state.

7. The apparatus of claim 3, wherein the open line port and the close line port are in fluid communication with a same chamber of the first plurality of chambers when the first piston is in the reset position and wherein the open line port and the close line port are in fluid communication with different chambers of the first plurality of chambers within the first housing when the first piston is in the close position and the open position.

8. The apparatus of claim 1, further comprising:

an open line in fluid communication with the open line port; and a close line in fluid communication with the close line port, wherein the open line and the close line are configured for fluid connection to a first control valve.

9. The apparatus of claim 1, wherein the first plurality of chambers includes an index chamber and further comprising:

a relief manifold that controls a flow of the hydraulic fluid from the primary line into the index chamber; and a metering system that controls a flow of the hydraulic fluid between the primary line and the secondary line to thereby control a buildup of pressure in the relief manifold, wherein the metering system includes a second housing, a second piston located within the second housing, a pilot-operated valve, and a check valve.

10. The apparatus of claim 1, further comprising:

a check valve disposed within the first piston, wherein the check valve controls a return of the hydraulic fluid from the auxiliary chamber of the first plurality of chambers into an index chamber of the first plurality of chambers.

11. The apparatus of claim 1, further comprising:

a pilot-operated cartridge that includes a member and a spring, wherein pressurization of the primary line moves the hydraulic fluid into the pilot-operated cartridge, thereby moving the member in a first direction to compress the spring and close the pilot-operated cartridge; and wherein venting the primary line moves the member in a second direction opposite the first direction to open the pilot-operated cartridge.

12. The apparatus of claim 11, wherein the first plurality of chambers includes a reset chamber and further comprising:

a reset check valve that controls a flow of the hydraulic fluid from the pilot-operated cartridge into the reset chamber to enable the first piston to be reset; and an anti-reset check valve that allows the hydraulic fluid from the reset chamber to move into a metering system when the first piston is not being reset.

13. The apparatus of claim 1, further comprising:

a reset guide member secured to the first piston within the first housing and used to guide the first piston into a reset position within the first housing.

14. The apparatus of claim 1, further comprising:

a second housing;

a second piston located within the second housing and movable within the second housing; and a second plurality of seals fixedly attached to the second piston such that the second plurality of seals defines a second plurality of chambers between the second piston and the second housing, wherein the primary line and the secondary line are fluidly connected to the second plurality of chambers; and wherein the primary line and the secondary line are used to control a first control valve by moving the first piston within the first housing and to control a second control valve by moving the second piston within the second housing.

15. The apparatus of claim 1, wherein the first piston has a fixed rotational orientation relative to the first housing.

16. A method for controlling one or more control valves, the method comprising:

pressurizing a primary line according to an operating sequence to move a first piston within a first housing such that one of an open line port and a close line port is in fluid communication with a selected chamber of a first control chamber and a second control chamber of a first plurality of chambers defined between the first piston and the first housing;

pressurizing a secondary line according to the operating sequence to move hydraulic fluid through the selected chamber and through the one of the open line port and the close line port in fluid communication with the selected chamber to thereby control a state of a first control valve; and resetting a position of the first piston using a reset code involving both the primary line and the secondary line.

17. The method of claim 16, wherein pressurizing the primary line comprises:

pressurizing the primary line according to the operating sequence to move the first piston in a first direction into a close position such that the close line port is in fluid communication with the first control chamber.

18. The method of claim 17, wherein pressurizing the secondary line comprises:

pressurizing the secondary line according to the operating sequence to move the hydraulic fluid into the first control chamber, through the close line port, and into a close line that fluidly connects the close line port to the first control valve to thereby switch the first control valve to a closed state.

19. The method of claim 16, wherein pressurizing the primary line comprises:

pressurizing the primary line according to the operating sequence to move the first piston in a first direction into an open position such that the open line port is in fluid communication with the second control chamber.

20. The method of claim 19, wherein pressurizing the secondary line comprises:

pressurizing the secondary line according to the operating sequence to move the hydraulic fluid into the first control chamber, through a control channel within the first piston, into the second control chamber, through the open line port, and into an open line that fluidly connects the open line port to the first control valve to thereby switch the first control valve to an open state.

* * * * *